US006828938B2

(12) United States Patent
Tran

(10) Patent No.: US 6,828,938 B2
(45) Date of Patent: Dec. 7, 2004

(54) MEMS PLANAR ANTENNA ARRAY

(75) Inventor: Allen Tran, San Diego, CA (US)

(73) Assignee: Kyocera Wireless Corp., San Diego, CA (US)

( * ) Notice: Subject to any disclaimer, the term of this patent is extended or adjusted under 35 U.S.C. 154(b) by 125 days.

(21) Appl. No.: 10/279,482

(22) Filed: Oct. 23, 2002

(65) Prior Publication Data

US 2004/0080456 A1 Apr. 29, 2004

(51) Int. Cl.[7] ..... H01Q 1/38
(52) U.S. Cl. ..... 343/700 MS; 343/745
(58) Field of Search ..... 343/700 MS, 846, 343/745, 815, 816, 817, 818, 853

(56) References Cited

U.S. PATENT DOCUMENTS 5,777,581 A * 7/1998 Lilly et al. ..... 343/700 MS
5,943,016 A * 8/1999 Snyder et al. ..... 343/700 MS
6,061,025 A * 5/2000 Jackson et al. ..... 343/700 MS
6,198,438 B1 * 3/2001 Herd et al. ..... 343/700 MS
6,501,427 B1 * 12/2002 Lilly et al. ..... 343/700 MS

* cited by examiner

*Primary Examiner*—Hoang V. Nguyen

(57) ABSTRACT

A MEMS planar antenna array is provided comprising a planar field of MEMSs. A lattice of parasitic elements can be formed by selectively connecting at least one MEMS in the field. An antenna active element is formed by selectively connecting MEMS in the field. Alternately, both the parasitic elements and the active elements are formed by connecting MEMS. The parasitic elements have a number, shape, length, distance from the active element, and position with respect to the active element that are formed in response to selectively connecting MEMS in the field. Further, a plurality of different parasitic element lattices can be formed in response to selectively connecting MEMS in the field. Likewise, the active element has a length, shape, and position that is formed in response to selectively connecting MEMS. Patch, monopole, and dipole antennas are among the antenna types that can be formed from the MEMS.

48 Claims, 18 Drawing Sheets

MEMS PLANAR ANTENNA ARRAY

BACKGROUND OF THE INVENTION

1. Field of the Invention

This invention generally relates to wireless communications antennas and, more particularly, to a selectable antenna array formed from a planar field of microelectromechanical switches (MEMSs).

2. Description of the Related Art

The size of portable wireless communications devices, such as telephones, continues to shrink, even as more functionality is added. As a result, the designers must increase the performance of components or device subsystems while reducing their size, or placing these components in less desirable locations. One such critical component is the wireless communications antenna. This antenna may be connected to a telephone transceiver, for example, or a global positioning system (GPS) receiver.

Wireless telephones can operate in a number of different frequency bands. In the US, the cellular band (AMPS), at around 850 megahertz (MHz), and the PCS (Personal Communication System) band, at around 1900 MHz, are used. Other frequency bands include the PCN (Personal Communication Network) at approximately 1800 MHz, the GSM system (Groupe Speciale Mobile) at approximately 900 MHz, and the JDC (Japanese Digital Cellular) at approximately 800 and 1500 MHz. Other bands of interest are GPS signals at approximately 1575 MHz and Bluetooth at approximately 2400 MHz.

Conventionally, good communication results have been achieved using a whip antenna. Using a wireless telephone as an example, it is typical to use a combination of a helical and a whip antenna. In the standby mode with the whip antenna withdrawn, the wireless device uses the stubby, lower gain helical coil to maintain control channel communications. When a traffic channel is initiated (the phone rings), the user has the option of extending the higher gain whip antenna. Some devices combine the helical and whip antennas. Other devices disconnect the helical antenna when the whip antenna is extended. However, the whip antenna increases the overall form factor of the wireless telephone.

It is known to use a portion of a circuitboard, such as a dc power bus, as an electromagnetic radiator. This solution eliminates the problem of an antenna extending from the chassis body. Printed circuitboard, or microstrip antennas can be formed exclusively for the purpose of electromagnetic communications. These antennas can provide relatively high performance in a small form factor. However, a wireless device that is expected to operate at a plurality of different frequencies may have difficulty housing a corresponding plurality of microstrip antennas. Even if all the microstrip antennas could be housed, the close proximity of the several microstrip antennas may degrade the performance of each antenna.

In some circumstances it is advantageous to be able to shape an antenna pattern. Then, the antenna pattern has additional gain in a desired direction, to improve the link margin with a communicating device. It is known to network a plurality of antenna elements and regulate the phase relationship between elements. The phase relationship between elements generates the antenna beam pattern. Likewise, an active element can be arrayed in a field, or lattice of parasitic elements. These parasitic elements, being either half-wavelength open radiators or quarter-wavelength ground-shunted radiators, can also be used to shape an antenna beam pattern. Unlike the phase-array antenna, whose pattern can easily be varied by electronic means, the parasitic elements must be manipulated by mechanical means if the beam is to shaped in a different form. Mechanical manipulation generally requires additional parts that take up room and degrade reliability. As a result, parasitic element lattices have not been practical for use in portable wireless communication devices.

FIG. 28 is a schematic diagram of a microelectromechanical switch (MEMS) (prior art). A MEMS is a semiconductor integrated circuit (IC) with an overlying mechanical layer that operates as a selectable connectable switch. That is, the underlying solid-state layer creates a field that can cause an overlying conductive material to move, permitting the conductive material to act as miniature single-pull single-throw switch. MEMS concepts were developed in labs in the 1980's and are just now beginning to be fabricated as practical products. As a result, the particular specifications and features of a MEMS are still under development. MEMS technology offers the possibility of extremely low loss switches miniature switches.

In communications applications, switches are often designed with semiconductor elements such as transistors or pin diodes. At microwave frequencies, however, these devices suffer from several shortcomings. PIN diodes and transistors typically have an insertion loss greater than 1 dB, which is the loss across the switch when the switch is closed. Transistors operating at microwave frequencies tend to have an isolation value of under 20 dB. This allows a signal to "bleed" across the switch even when the switch is open. PIN diodes and transistors have a limited frequency response and typically only respond to frequencies under 20 GHz. In addition, the insertion losses and isolation values for these switches varies depending on the frequency of the signal passing through the switches. These characteristics make semiconductor transistors and pin diodes a poor choice for switches in microwave applications.

As noted in U.S. Pat. No. 6,440,767 (Loo et al.), a microwave MEMS can be made utilizing an armature design. One end of a metal armature is affixed to an output line, and the other end of the armature rests above an input line. The armature is electrically isolated from the input line when the switch is in an open position. When a voltage is applied to an electrode below the armature, the armature is pulled downward and contacts the input line. This creates a conducting path between the input line and the output line through the metal armature. This switch provides only a single-pole, single-throw (SPST) function, that is, the switch is either open or closed.

A SPST MEMS switch can be formed from a multiple-layer armature with a suspended biasing electrode and a conducting transmission line affixed to the structural layer of the armature. A conducting dimple is connected to the conducting line to provide a reliable region of contact for the switch. The switch is fabricated using silicon nitride as the armature structural layer and silicon dioxide as a sacrificial layer supporting the armature during fabrication.

A MEMS switch suitable for RF or microwave applications typically can have a very low insertion loss (less than 0.2 dB at 45 GHz) and a high isolation when open (greater than 30 dB) over a large bandwidth, as compared to semiconductor transistors and pin diodes. These characteristics give the MEMS switch the potential to not only replace traditional narrow-bandwidth PIN diodes and transistor switches in microwave circuits, but to create a whole new class of high performance and compact microwave switch circuits. RF signals often must be switched between two destinations, such as when switching an RF signal between a first antenna array and a second antenna array. Switches that support this configuration are classified as single-pole, double-throw (SPDT) switches.

It would be advantageous if a single wireless communications telephone antenna could be made to operate at a plurality of frequencies using MEMS devices.

It would also be advantageous if the antenna beam pattern of the above-mentioned multi-frequency MEMS antenna could be controlled.

It would be advantageous if the MEMS devices could be used to vary the electrical length of parasitic elements in a parasitic element antenna array.

It would be advantageous if the phase relationship between a MEMS antenna active element and the parasitic elements could be controlled to beam shape the antenna pattern.

It would be advantageous if the MEMS antenna could be fabricated on a single planar surface or a dielectric sheet.

SUMMARY OF THE INVENTION

The present invention provides a microstrip, or printed circuitboard antenna that is made with MEMSs to vary the actual physical length of the printed line active element radiators. The MEMSs can be used to form selectable connected conductive sections that vary the length, position, and shape of the antenna active element. In this manner, the antenna operating frequency, bandpass, or beam pattern can be modified. In addition, the active element is situated in a lattice of MEMS parasitic elements. The MEMS devices in the parasitic elements serve multiple purposes. The length of the parasitic element can be modified to operate at different frequencies. The position and distance with respect to the active element can be modified to change antenna beam pattern. Since both the active and parasitic elements are formed on a common, planar surface, the antenna is relatively easy to manufacture. Further, the thin profile presented by the planar structure is relatively small, permitting the antenna to be used in portable electronic devices.

Accordingly, a MEMS planar antenna array is provided comprising a planar field of MEMSs. In one aspect of the antenna, a lattice of parasitic elements is formed by selectively connecting at least one MEMS in the field. In another aspect, an antenna active element is formed by selectively connecting a MEMS in the field. Alternately, both the parasitic elements and the active elements are formed by connecting MEMSs.

The parasitic elements have a number, shape, length, and distance from the active element, and a position with respect to the active element that are formed in response to selectively connecting MEMS in the field. Further, a plurality of parasitic element lattices are formed in response to selectively connecting MEMS in the field. Likewise, the active element has a length, shape, and position that is formed in response to selectively connecting MEMS in the field. Patch, monopole, and dipole antennas are among the antenna types that can be formed from the MEMS.

Additional details of the above-described planar antenna array and a method for forming a antenna array from a planar field of MEMS are provided below.

DETAILED DESCRIPTION OF THE PREFERRED EMBODIMENTS

Figure 1:
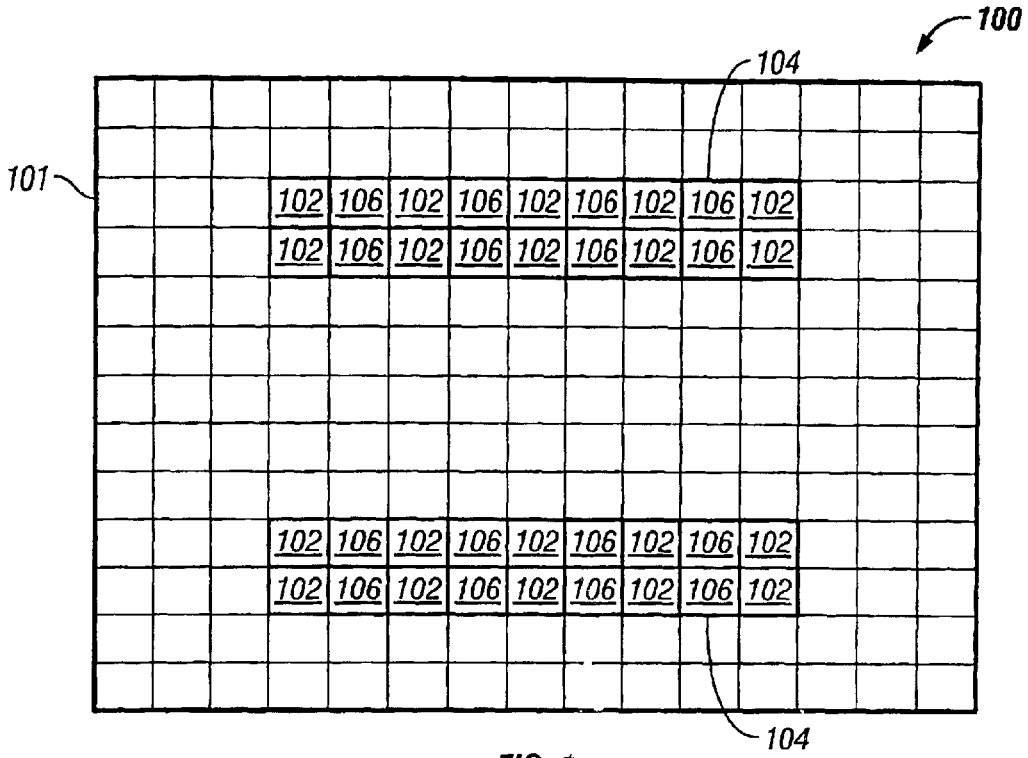
FIG. 1 is a plan view of the present invention microelectromechanical switch (MEMS) planar antenna array.

FIG. 1 is a plan view of the present invention microelectromechanical switch (MEMS) planar antenna array. The antenna array 100 comprising a planar field 101 of MEMSs 102. A lattice of parasitic elements can be formed by selectively connecting a MEMS 102 in the field 101. As shown, a lattice is formed with two parasitic elements 104. Each parasitic element 104 includes ten MEMS sections 102. Although a rectangular field 101 is shown, the present invention is not limited to any particular field shape. As explained in more detail below, the field 101 may be comprised of MEMS 102 exclusively, or a combination of MEMS 102 sections and non-switching (non-MEMS) conductive areas. In other aspects of the array 100, the field may include non-switching non-conductive areas in combination with MEMS 102, or further in combination with MEMS 102 and non-switching conductive areas.

In one aspects of the antenna array 100, the field can be comprised exclusively of connected MEMS sections 102. Alternately as shown, a plurality of conductive sections 106 can be interposed between MEMS 102 in the field 101. Then, the parasitic elements 104 are formed from a plurality of MEMS 102 and conductive 106 sections.

It will be understood that a planar MEMS antenna is advantageous in a wireless communications device such as a wireless telephone and also in a base station.

Figure 2:
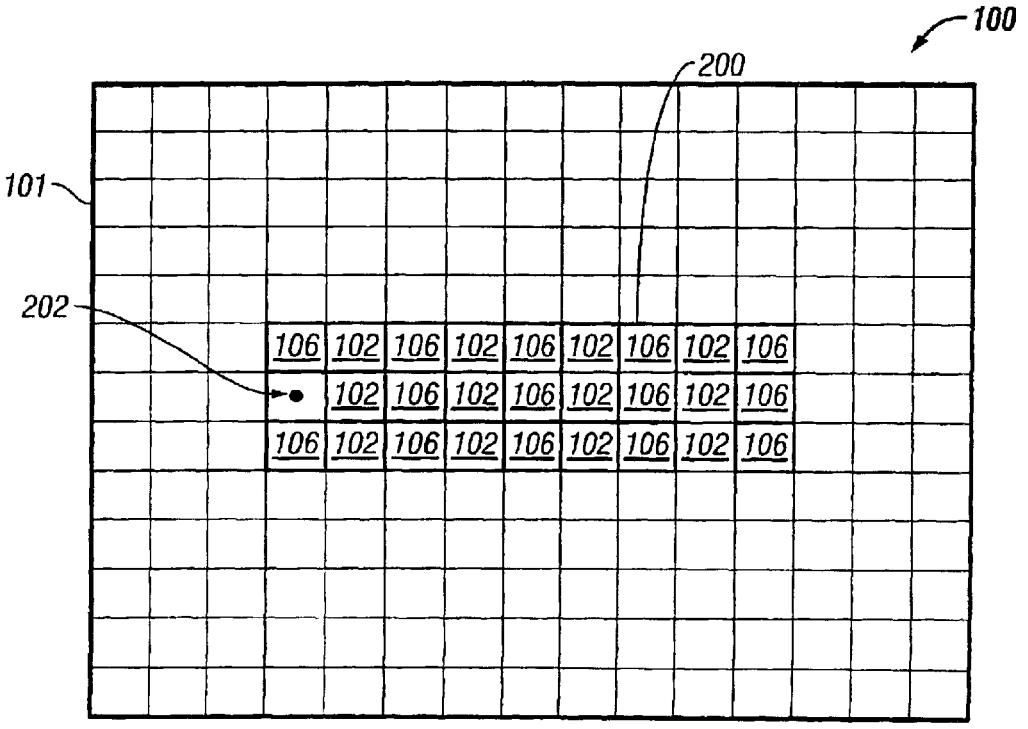
FIG. 2 is a plan drawing depicting another aspect of the present invention planar antenna array.

FIG. 2 is a plan drawing depicting another aspect of the present invention planar antenna array 100. An active element 200 is shown with a transceiver port 202 or antenna feed. The transceiver port 202 can be a coaxial line, shielded wire, or twisted wire pair for example, connected to the antenna port of a transceiver (not shown). The term transceiver as used herein is intended to describe a wireless communications device that is capable of transmitting, receiving, or both transmitting and receiving wireless communication signals via the antenna array 100. The active element 200 is formed by selectively connecting MEMS 102 in the field 101.

As described above, in one aspect the field 101 can be comprised exclusively of connected MEMS sections 102. Alternately as shown, a plurality of conductive sections 106 can be interposed between MEMS 102 in the field 101. Then, the active element 200 is formed from a plurality of MEMS 102 and conductive 106 sections.

Figure 3A:
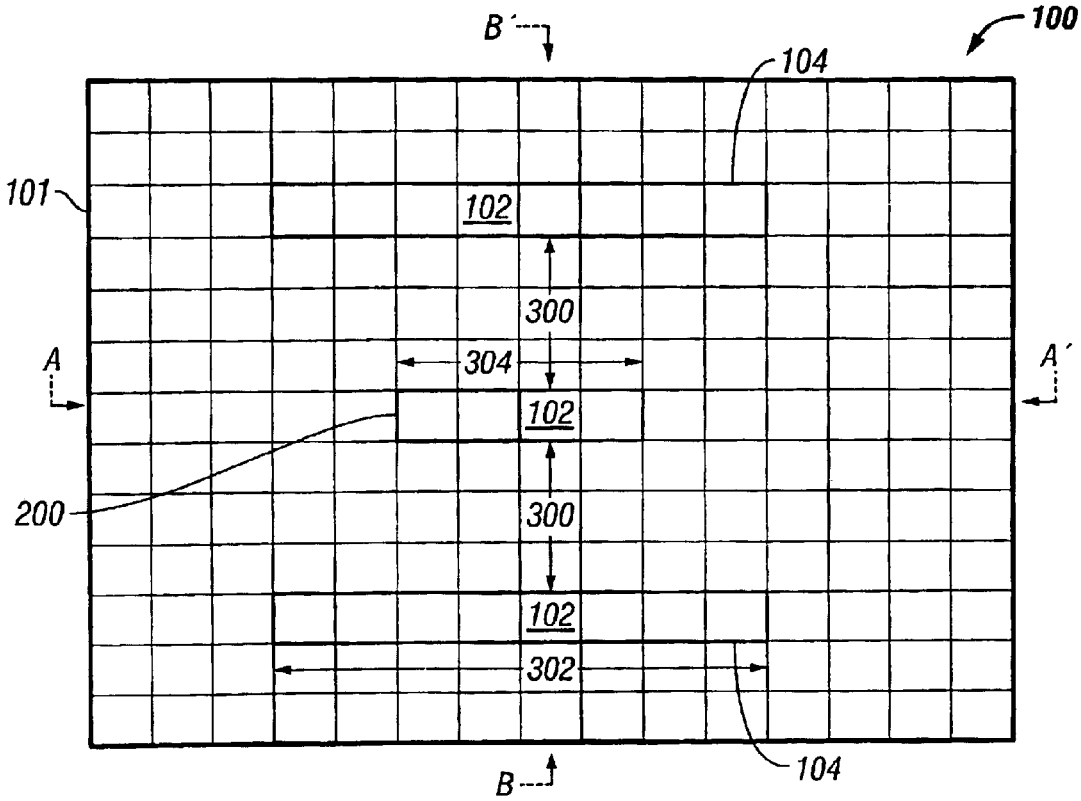
FIGS. 3*a* through 3*c* illustrate another variation of the present invention planar antenna array, and corresponding antenna patterns.
Figure 3B:
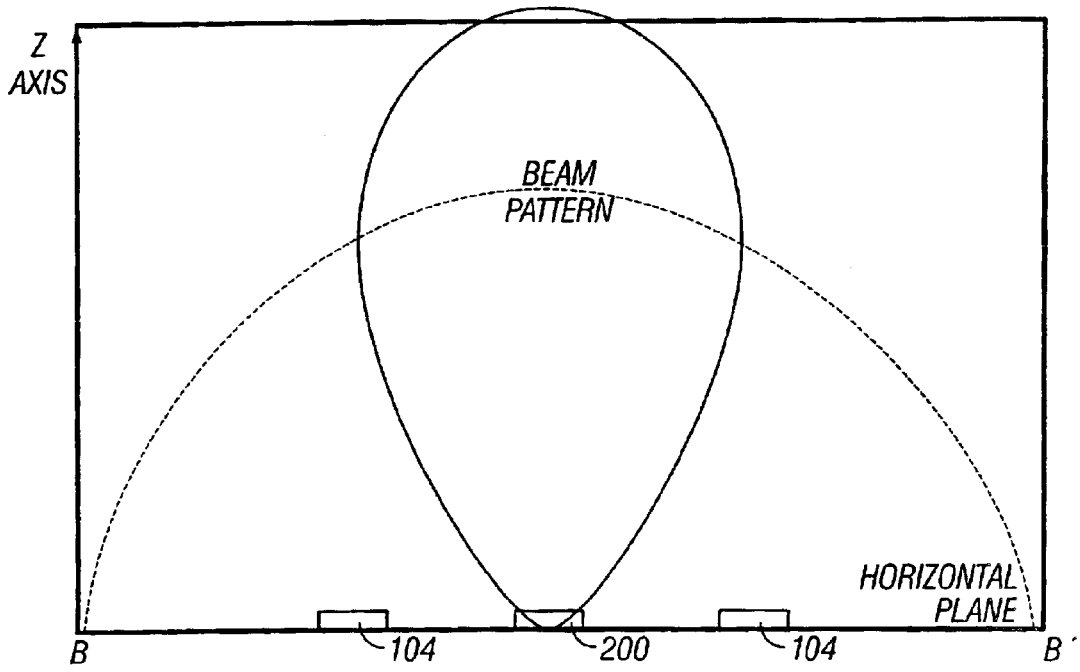
Figure 3C:
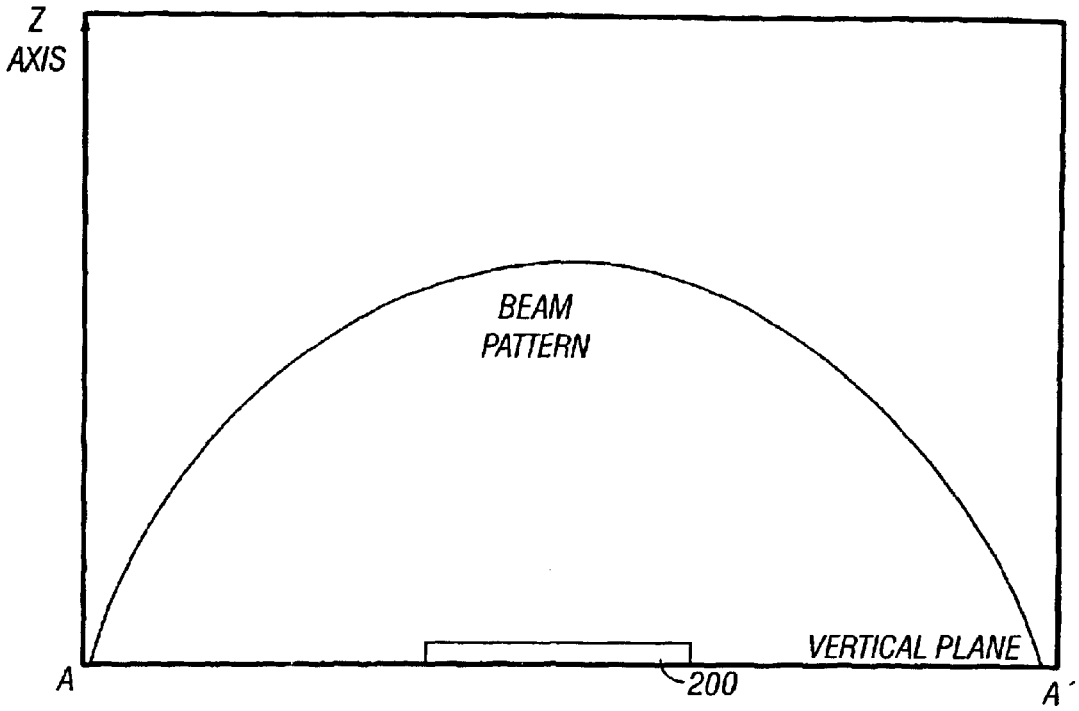

FIGS. 3*a* through 3*c* illustrate another variation of the present invention planar antenna array, and its corresponding antenna patterns. In FIG. 3*a*, both the parasitic elements 104 and the active element 200 can be formed by selectively connecting MEMS 102 in the field 101. For simplicity, the following descriptions of the invention will generally based upon the assumption that both parasitic elements and the active element are formed using MEMSs. However, it should be understood that only one of the parasitic or active elements need necessarily be formed from MEMS sections.

The term horizontal, are used herein, refers to the width of the sheet on which the figures are drawn. The term vertical refers to the length of the sheet, and a z axis goes into (or out of) the surface of the sheet. Therefore, a horizontal plane is a plane formed in the z axis that "cuts" the width of the sheet. A vertical plane is formed in the z axis and cuts the length of the sheet.

FIG. 3*b* is a partial cross-sectional view showing the shape of the antenna beam pattern in the horizontal plane. Note, the dotted lines represent the antenna beam pattern that would exist if the parasitic elements were not present.

FIG. 3*c* is a diagram illustrating the shape of the antenna beam pattern in the vertical plane.

Figure 4:
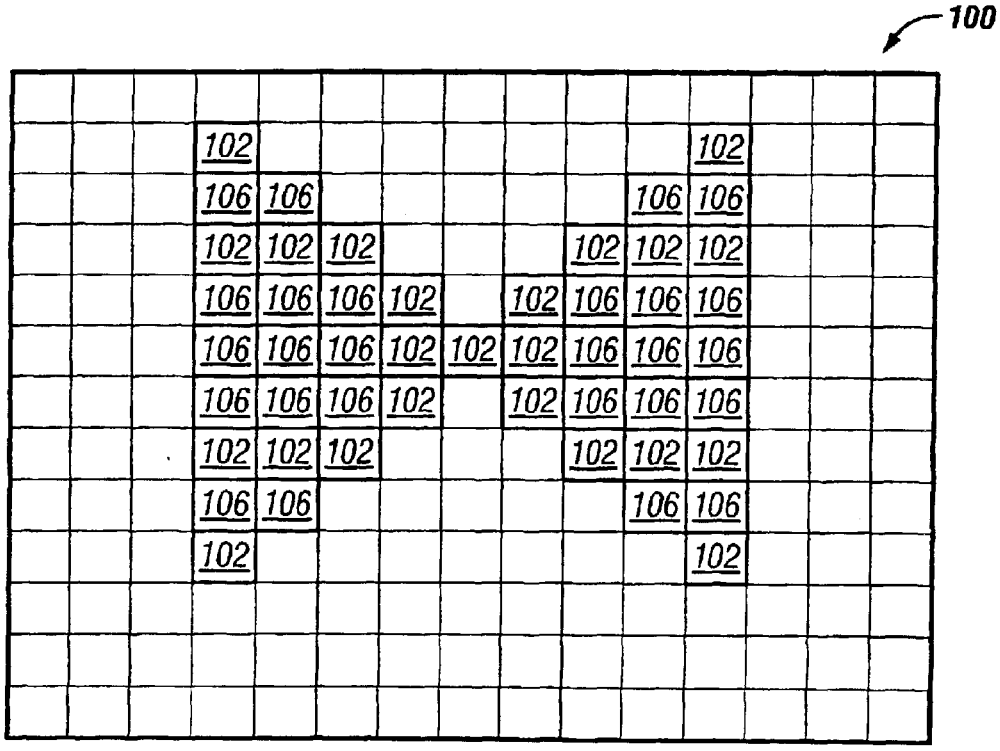
FIG. 4 is a view of the antenna array depicting a parasitic element in greater detail.

FIG. 4 is a view of the antenna array 100 depicting a parasitic element 104 in greater detail. The parasitic element has a shape that is formed in response to selectively connecting MEMS 102 in the field 101. As shown, the parasitic element 104 is formed in the shape of a bowtie. The parasitic element can be formed using all MEMS sections 102, or a combination of MEMS sections 102 and conductive sections 106. Returning to FIG. 1, the parasitic elements have a rectangular shape that is formed in response to selectively connecting MEMS 102 in the field 101. The present invention parasitic elements are not limited to any particular shape.

Returning to FIG. 3*a*, it can be seen that the parasitic elements 104 have a distance 300 from an active element 200 that is formed in response to selectively connecting MEMS 102 in the field 101. The parasitic elements 104 have a length 302 that is formed in response to selectively connecting MEMS 102 in the field 101. Generally, the parasitic elements 104 have an effective length that is an odd multiple of a half-wavelength of the operating frequency, if the parasitic element is open (not connected to ground or a counterpoise). If the parasitic element is connected to an underlying ground, using a via for example, then the parasitic element can be an odd multiple of a quarter-wavelength of the operating frequency of the antenna. It is also generally true that the parasitic element length 302 is of most effect when it is parallely aligned with the length of the active element 200. However, other alignments are also possible.

The parasitic elements 104 have a position with respect to an active element 200 that is formed in response to selectively connecting MEMS 102 in the field 101. The positioning of the parasitic elements 104 controls the shape of the beam that is formed by the operation of the active element in the presence of parasitic elements. As shown is FIG. 3*a*, the parasitic elements lengths are parallely aligned with the active element, and all the elements are bisected (cut in equal halves) with the same plane. Generally, the term "position" as used herein is understood to mean the alignment relationship between the active and parasitic elements. For simplicity, this relationship will be expressed in comparing the orientation of element lengths and a comparison of the planes that bisect theses lengths. In some instances, depending upon the shape of the elements, a length may be arbitrary, and it is the element shapes that are compared. It should be understood that parasitic elements need not have lengths parallely aligned with the length of the active element, or with each other. Neither is it necessary that the parasitic elements be bisected in the same plane as the active element. Neither is it necessary that the parasitic elements all be bisected with the same plane.

Figure 5:
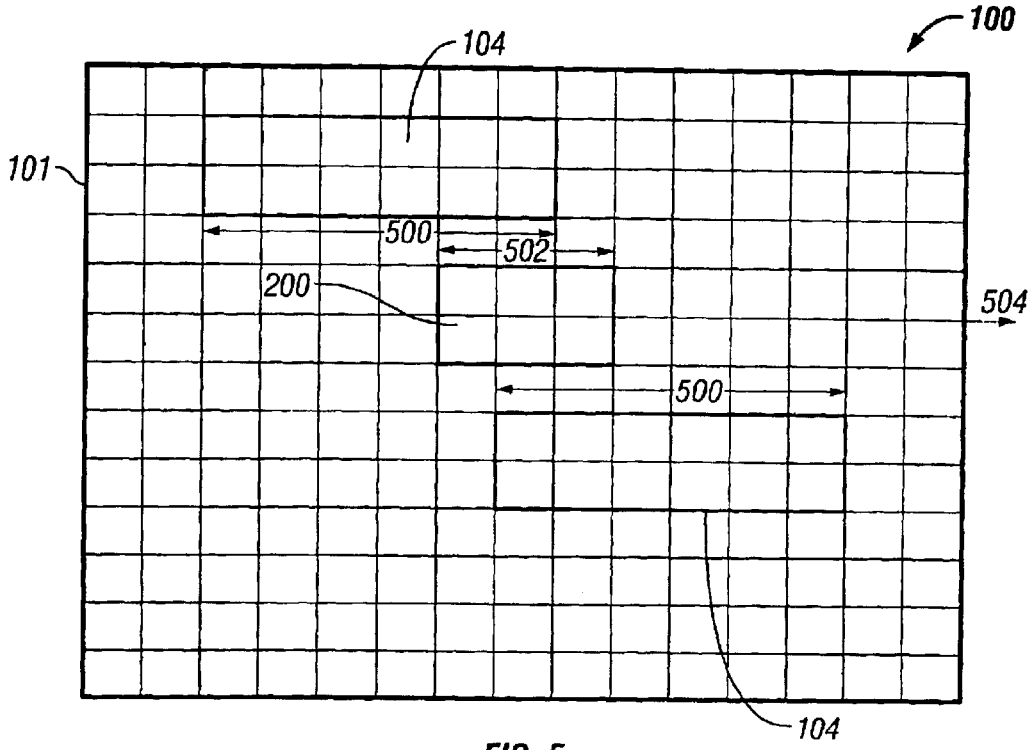
FIG. 5 is a view of the antenna array depicting an exemplary parasitic element positions.

FIG. 5 is a view of the antenna array 100 depicting an exemplary parasitic element 104 positions. As shown, the lengths 500 of the parasitic elements 104 are parallely aligned with the length 502 of the active element 200 (along a vertical plane 504). However, the elements are all bisected along different (horizontal) planes.

Figure 6A:
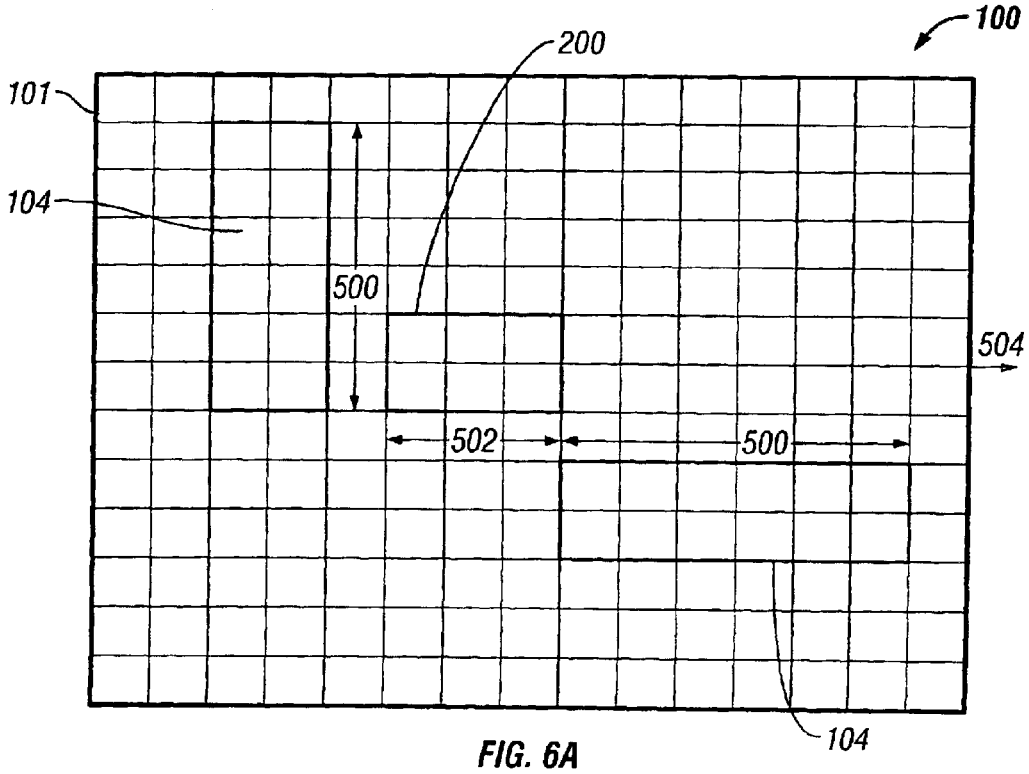
FIGS. 6*a* through 6*c* are other views of the antenna array depicting exemplary parasitic element positions.
Figure 6B:
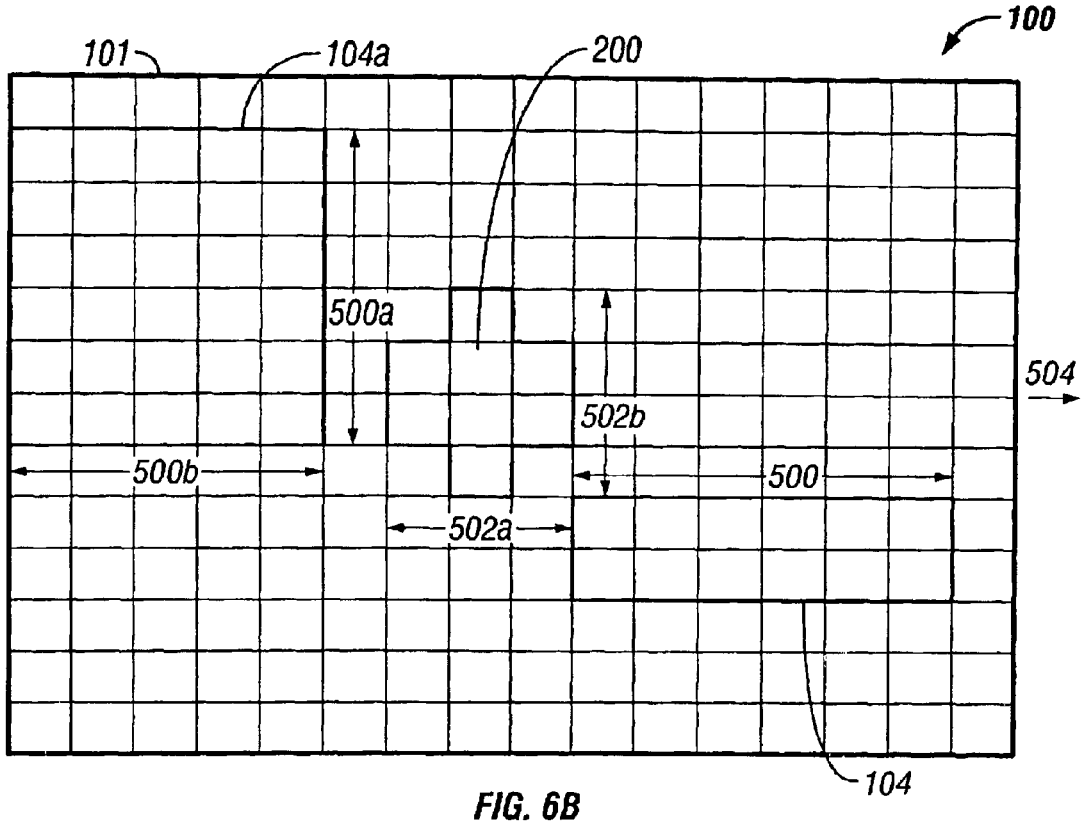
Figure 6C:
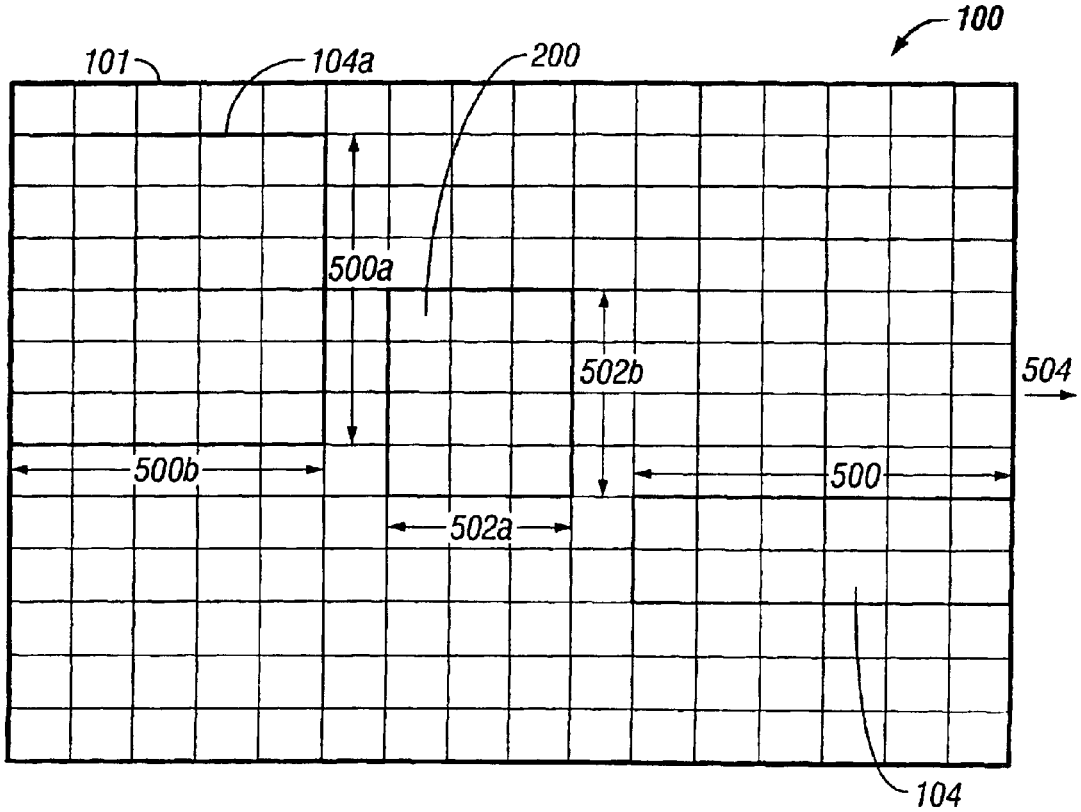

FIGS. 6*a* through 6*c* are other views of the antenna array 100 depicting exemplary parasitic element 104 positions. As shown in FIG. 6*a*, only one of the lengths 500 of the parasitic elements 104 is parallely aligned with the length 502 of the active element 200 (along a vertical plane 504). Again, the elements are all bisected along different (horizontal) planes. Note that the beam pattern formed by the antenna array of FIG. 6*a* may not necessarily be especially practical. However, it is presented to indicate potential alignments, and alignment relationships.

In FIG. 6*b*, the active element 200 has a length 502*a* in the vertical plane and a length 502*b* in the horizontal plane. Such an arrangement of lengths permits the active element 200 to be cross-polarized, or polarized in both the vertical and horizontal planes. Alternately stated, the active element has a width portion 502*b* that is formed in response to selectively connecting MEMS. Considered yet another way, the active element has a length portion 502*b* that is formed in response to selectively connecting MEMS. Likewise, parasitic element 104*a* has a length 500*a* in the horizontal plane and a length 500*b* in the vertical plane. This arrangement permits the parasitic element 104*a* to be effectively coupled to the active element 200 in both the horizontal and vertical axes of polarization. Alternately stated, the parasitic element(s) have a width that is formed in response to selectively connecting MEMS.

FIG. 6*c* is a variation of FIG. 6*b* where the active element 200 has been formed into a square shape. That is, the width 502*b* is formed to be symmetric to the length 502*a*. FIGS. 5 and 6*a*, 6*b*, and 6*c* are some examples that depict some of the many possibilities that exist for positioning the parasitic elements with respect to the active element and with respect to each other.

Figure 7A:
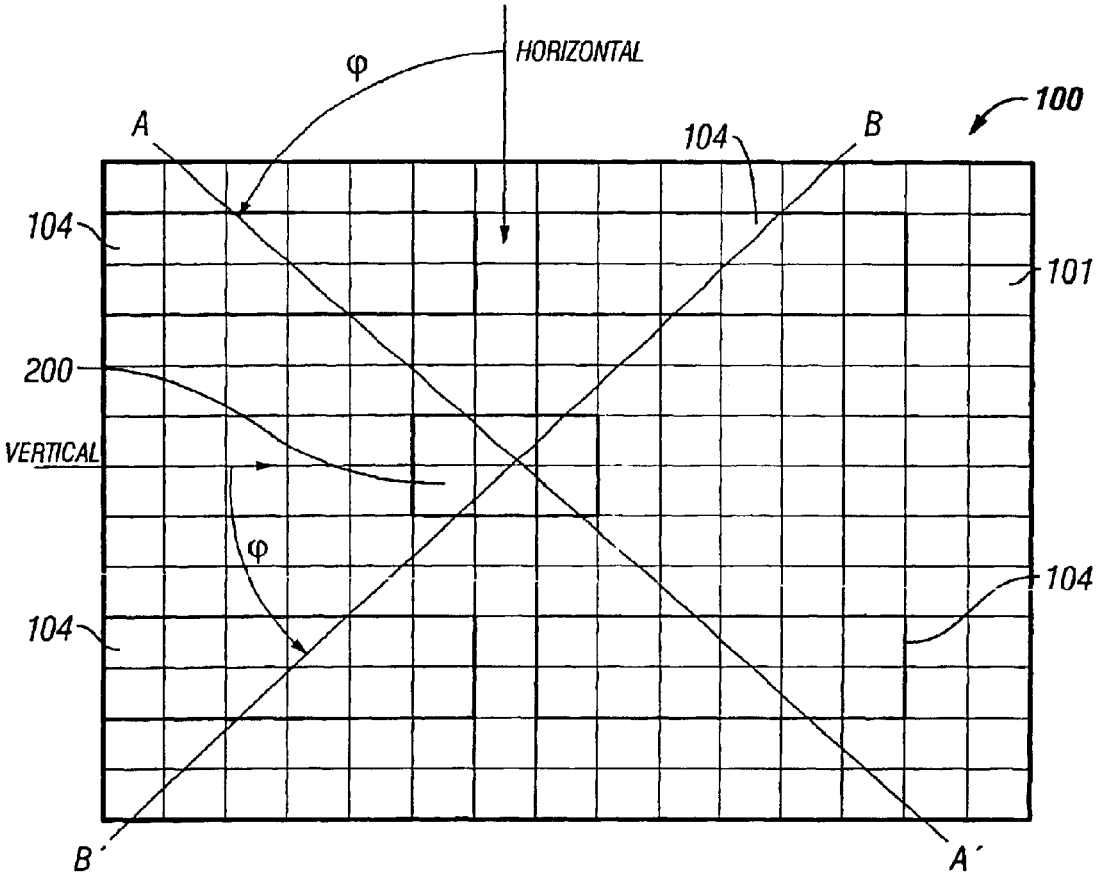
FIGS. 7*a* through 7*c* is a plan view of the present invention planar antenna illustrating the number of parasitic elements in a lattice, with corresponding beam patterns.
Figure 7B:
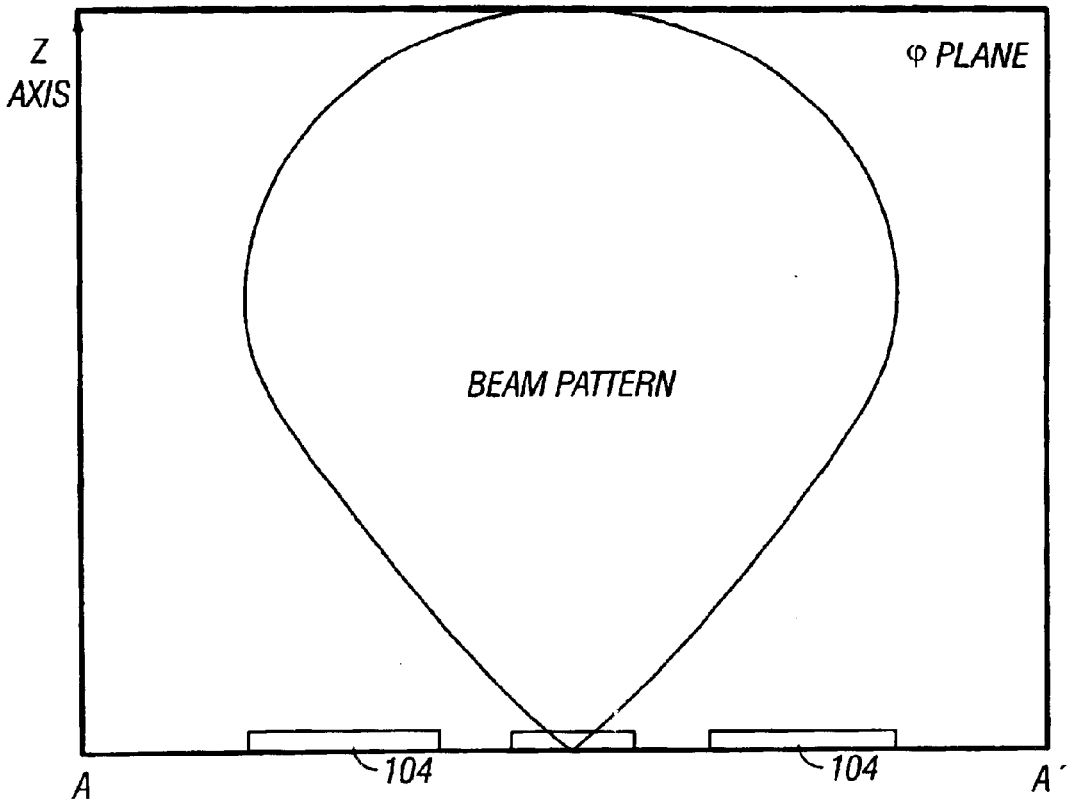
Figure 7C:
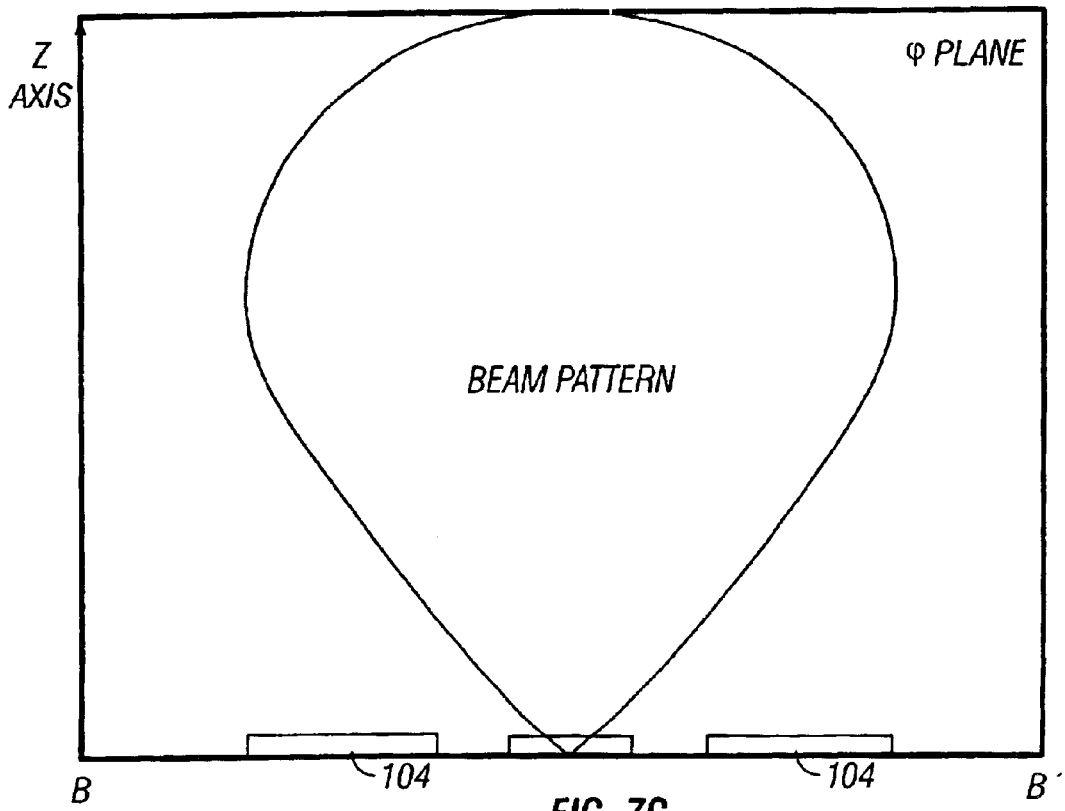

FIGS. 7*a* through 7*c* is a plan view of the present invention planar antenna illustrating the number of parasitic elements in a lattice, with corresponding beam patterns. The number of parasitic elements in the lattice is responsive to selectively connecting MEMS in the field 101. As shown in FIG. 7*a*, there are four parasitic elements 104 in the lattice. The angle θ is the angle between the where the active element 200 is bisected and one of the parasitic elements is bisected, defined with respect to the horizontal axis. The angle ϕ is the angle between where the active element 200 is bisected and another parasitic element 104 is bisected, defined with respect to the vertical axis. Note that the angle ϕ is not necessarily orthogonal to the angle θ. Also note that is some configurations a unique angle can be drawn between the active element and each parasitic element. Returning to FIG. 3*a*, there are two parasitic elements in the lattice. It should be understood that the number of parasitic elements in a lattice is not limited to any particular number.

FIG. 7*b* is a partial cross-sectional view showing the shape of the antenna beam pattern in the AA' plane (see FIG. 7*a*).

FIG. 7*c* is a diagram illustrating the shape of the antenna beam pattern in the BB' plane. Despite the shape of the beam pattern it should be noted that the antenna is vertical polarized, as the active element length is aligned along a vertical plane.

A plurality of parasitic element lattices can be formed in response to selectively connecting MEMS in the field. That is, the antenna can be reconfigured into a plurality of beam patterns in response to changing the lattice structures. For example, at a first time the lattice can be structured as shown in FIG. 3*a*. At a second time the lattice can be structured as shown in FIG. 5, and at a third time as shown in FIG. 7*a*.

Alternately stated, a first lattice of parasitic elements 104 is formed in response to connecting a first plurality of MEMS 102, and a second lattice of parasitic elements 104 is formed in response to connecting a second plurality of MEMS. Theoretically, there is no limit to the number of lattices that can be formed. Practically, the number of lattices is limited to the size of the field 101, the percentage of the field occupied by MEMS sections, and the size of the MEMS sections.

Likewise, it can be seen that the first lattice of parasitic elements 104 may occupy a first set of positions with respect to the active element 200, while the second lattice of parasitic elements 104 occupy a second set of positions with respect to the active element 200. Generally, it can be stated that a plurality of parasitic element lattices occupy a plurality of positions with respect to the active element. That is, a plurality of lattices can be formed where each lattice locates at least one parasitic element in a position that is different from the other lattice formations. The subject of lattice formation and position are discussed in greater detail below.

Returning to FIG. 3*a*, it can be seen that the active element 200 has a length 304 that is formed in response to selectively connecting MEMS in the field. The length 304 is dependent upon the antenna type and the antenna operating frequency. The operating frequency of the active element 200 can be changed by using MEMS sections 102 to change the length of the active element 200. Likewise, the active element 200 has a shape that is responsive to selectively connecting MEMS 102 in the field 101. As shown in FIG. 3*a*, the active element has a rectangular shape. Referring briefly to FIG. 4, the depicted element (described earlier as a parasitic element) could be described as a bowtie shaped dipole active element with two feedpoints (not shown). Theoretically, there are no limitations to the shape of the active element. Practically, the shape is limited to the placement of feedpoints, the size of the field 101, the percentage of the field occupied by MEMS sections, the size of the MEMS sections, and area in the field that is occupied by the parasitic elements.

Since the length of the active element (and parasitic elements) is related to the operating frequency of the antenna, the operating frequency of the antenna array can be varied by engaging and disengaging MEMS sections. With particular interest to a wireless telephone for example, the active element can be made to communicate at frequencies such as 824 to 894 MHz, 1850 to 1990 MHz, 1565 to 1585 MHz, or 2400 to 2480 MHz.

Figure 8:
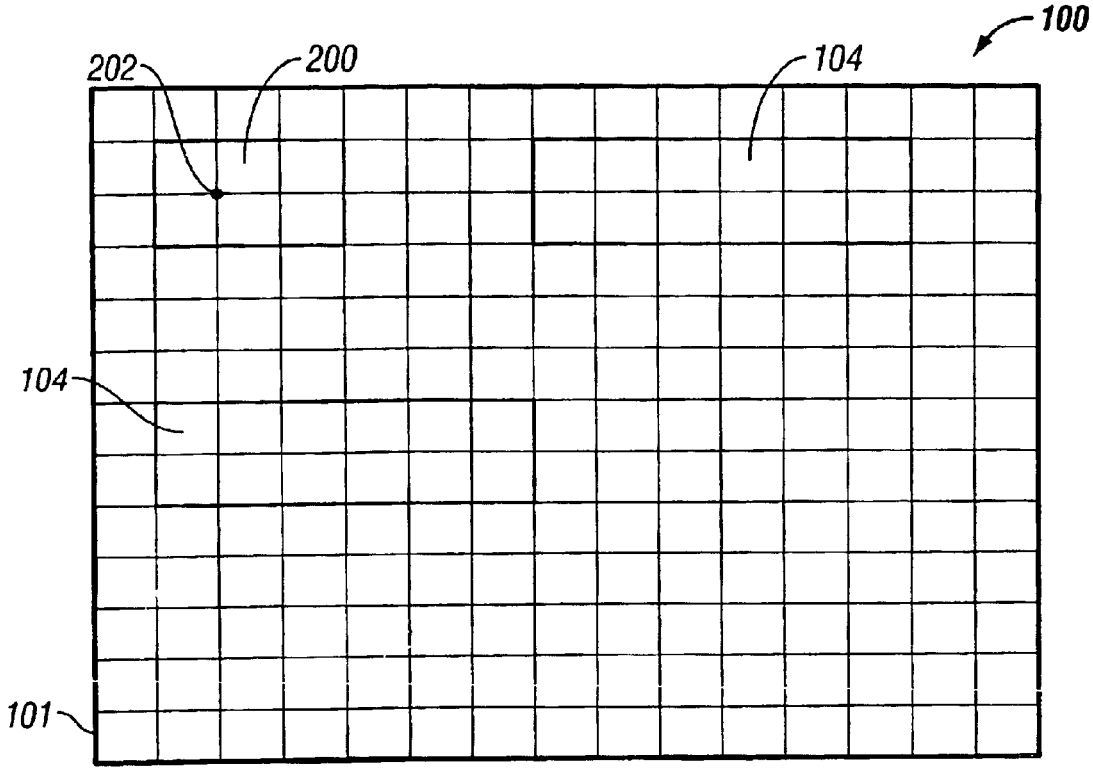
FIG. 8 is a plan view of the planar antenna array illustrating the position of the active element.

FIG. 8 is a plan view of the planar antenna array illustrating the position of the active element. As shown, the active element 200 has a position in the upper-right corner of the field 101. Returning to FIG. 3*a*, the active element 200 is positioned in approximately the center of the field. The position of the active element is defined herein to be made with respect to an edge or a corner of the field. Generally, the active element 200 has a position that is responsive to selectively connecting MEMS in the field 101. Practically, the position of the active elements is limited to the position of the feedpoint 202, or selectively engageable feedpoints in the field 101.

The planar antenna array 100 of the present invention can be realized using an active element configured as either a patch, dipole, or monopole antenna. However, it should be understood that the present invention can be used to enable any antenna style that is configurable along a plane. The active elements shown in FIGS. 1-3*a* and 5-8 are patch antenna active elements.

Generally, it should be understood that the lattice of parasitic elements includes parasitic elements that have reconfigurable sizes and locations. Likewise, the active element has reconfigurable sizes and locations.

Figure 9:
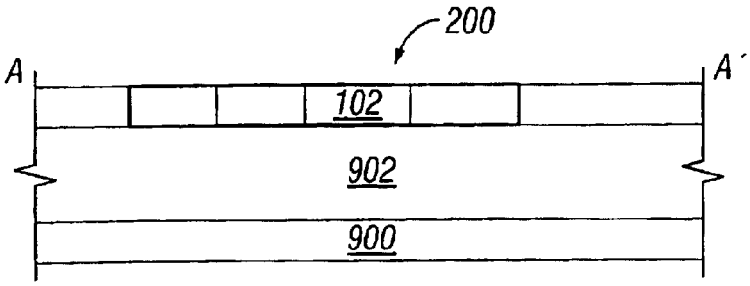
FIG. 9 is a partial cross-sectional view of the planar antenna array of FIG. 3*a*.

FIG. 9 is a partial cross-sectional view of the planar antenna array of FIG. 3*a*. The planar antenna array further comprises a planar counterpoise 900, which can be a groundplane in some aspects of the antenna, and a dielectric layer 902 overlying the counterpoise 900. The active element 200 is a patch antenna overlying the dielectric layer 902. Note that although not specifically shown, more than one dielectric layer may overlie the counterpoise 900. Further, the layering of dielectrics may vary. For example, the number of dielectric layers or the dielectric constant of the layer(s) may be different underlying parasitic elements, than it is underlying the active element.

Figure 10:
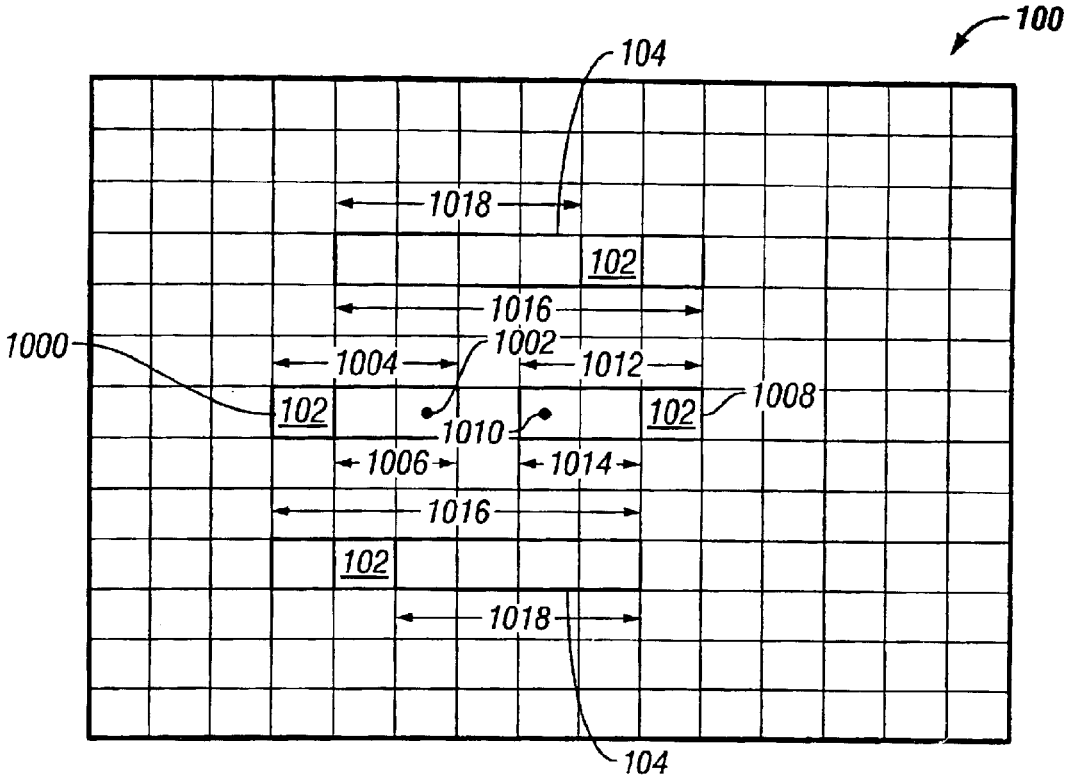
FIG. 10 is a plan view of the present invention planar antenna array where the active element is enabled as a dipole.

FIG. 10 is a plan view of the present invention planar antenna array where the active element is enabled as a dipole. A radiator 1000, with a feedpoint 1002, has an effective length 1004 of an odd multiple of a quarter-wavelength at a first frequency responsive to connecting a radiator MEMS 102. The radiator has an effective length 1006 of an odd multiple of a quarter-wavelength at a second frequency responsive to disconnecting the radiator MEMS 1002. An effective length of an odd multiple of a quarter-wavelength is $(2n+1)(\lambda/4)$, where n=0, 1, 2, . . .

Likewise, a counterpoise 1008, with a feedpoint 1010, has an effective length 1012 of an odd multiple of a quarter-wavelength at the first frequency responsive to connecting a counterpoise MEMS 102 and an effective length 1014 of an odd multiple of a quarter-wavelength at a second frequency responsive to disconnecting the counterpoise MEMS.

Each parasitic element 104, two of which are shown, has an effective length 1016 of an odd multiple of a half-wavelength at the first frequency responsive to connecting their corresponding MEMS 102 and an effective length 1018 of an odd multiple of a half-wavelength odd multiple length at a second frequency responsive to disconnecting their corresponding MEMS. An effective length of an odd multiple of a half-wavelength is $(2n+1)(\lambda/2)$, where n=0, 1, 2, . . . Note that the invention is not limited to any particular number of parasitic elements. Further note that although open half-wavelength parasitic elements have been described, the invention can also be enabled, with some modifications, with quarter-wavelength parasitic elements that are shorted.

Although a two-frequency version of a planar antenna array dipole has been described above, the present invention is not necessarily so limited. The two-frequency example may be extrapolated further. That is, the radiator 1000 may have an effective length of an odd multiple of a quarter-wavelength at a first plurality of frequencies in response to connecting a second plurality of radiator MEMSs. The number of MEMS sections does not necessarily equal the number of selectable frequencies. Likewise, the counterpoise 1008 would have an effective length of an odd multiple of a quarter-wavelength at the first plurality of frequencies in response to connecting a second plurality of counterpoise MEMSs. Then, each parasitic element would have an effective length of an odd multiple of a half-wavelength at the first plurality of frequencies in response to connecting their corresponding second plurality of MEMS.

Figure 11A:
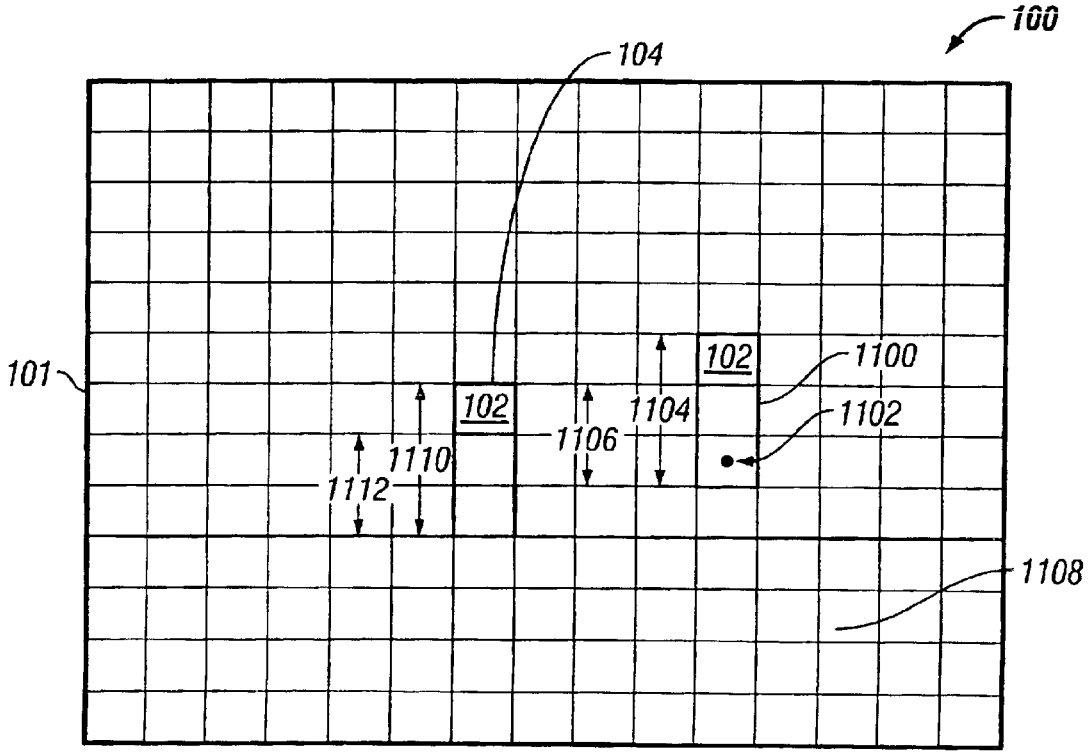
FIGS. 11*a* and 11*b* are plan views of the present invention planar antenna array where the active element is enabled as a monopole.
Figure 11B:
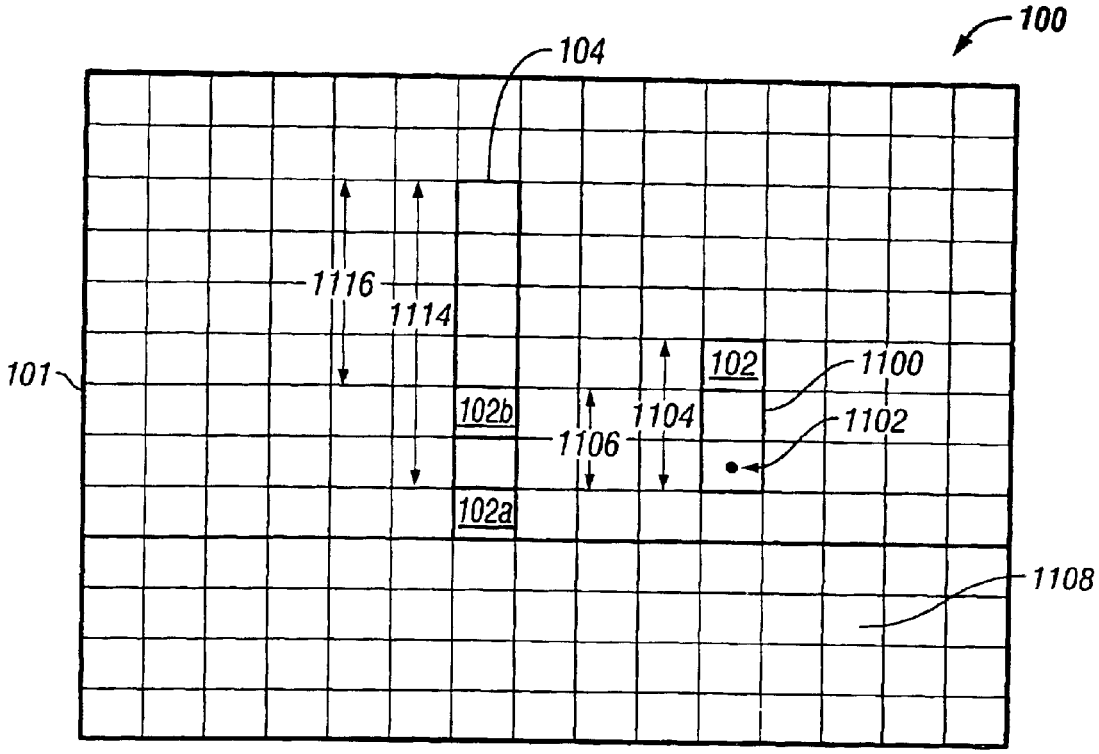

FIGS. 11*a* and 11*b* are plan views of the present invention planar antenna array where the active element is enabled as a monopole. FIG. 11*a* shows a radiator 1100, with a feedpoint 1102, having an effective length 1104 of an odd multiple of a quarter-wavelength at a first frequency responsive to connecting a radiator MEMS 102. The radiator 1100 has an effective length 1106 of an odd multiple of a quarter-wavelength at a second frequency responsive to disconnecting the radiator MEMS 102. The planar antenna array 100 further includes a planar counterpoise groundplane 1108. The counterpoise 1108 may, or may not include MEMS sections. Each parasitic element, one of which is shown, is connected to the counterpoise 1108 and has an effective length 1110 of an odd multiple of a quarter-wavelength at the first frequency in response to connecting their corresponding MEMS 102 and an effective length 1112 of an odd multiple of a quarter-wavelength at a second frequency responsive to disconnecting their corresponding MEMS 102.

FIG. 11*b* illustrates a variation of the monopole antenna of FIG. 11*a* where the parasitic element is an open, instead of being shorted to the counterpoise 1108. Each parasitic element, one of which is shown, is connected to the counterpoise 1108 through a MEMS 102 and has an effective length 1114 of an odd multiple of a half-wavelength at the first frequency in response to disconnecting MEMS 102*a* and an effective length 1116 of an odd multiple of a half-wavelength at a second frequency responsive to disconnecting MEMS 102*b*.

Although a two-frequency version of a planar antenna array monopole has been described above, the present invention is not necessarily so limited. The two-frequency example may be extrapolated further. That is, the radiator 1100 may have an effective length of an odd multiple of a quarter-wavelength at a first plurality of frequencies in response to connecting a second plurality of radiator MEMSs. The number of MEMS sections does not necessarily equal the number of selectable frequencies. Each parasitic element 104, then, is connected to the counterpoise 1108 and has an effective length of an odd multiple of a quarter-wavelength at the first plurality of frequencies in response to connecting their corresponding MEMS.

Figure 12A:
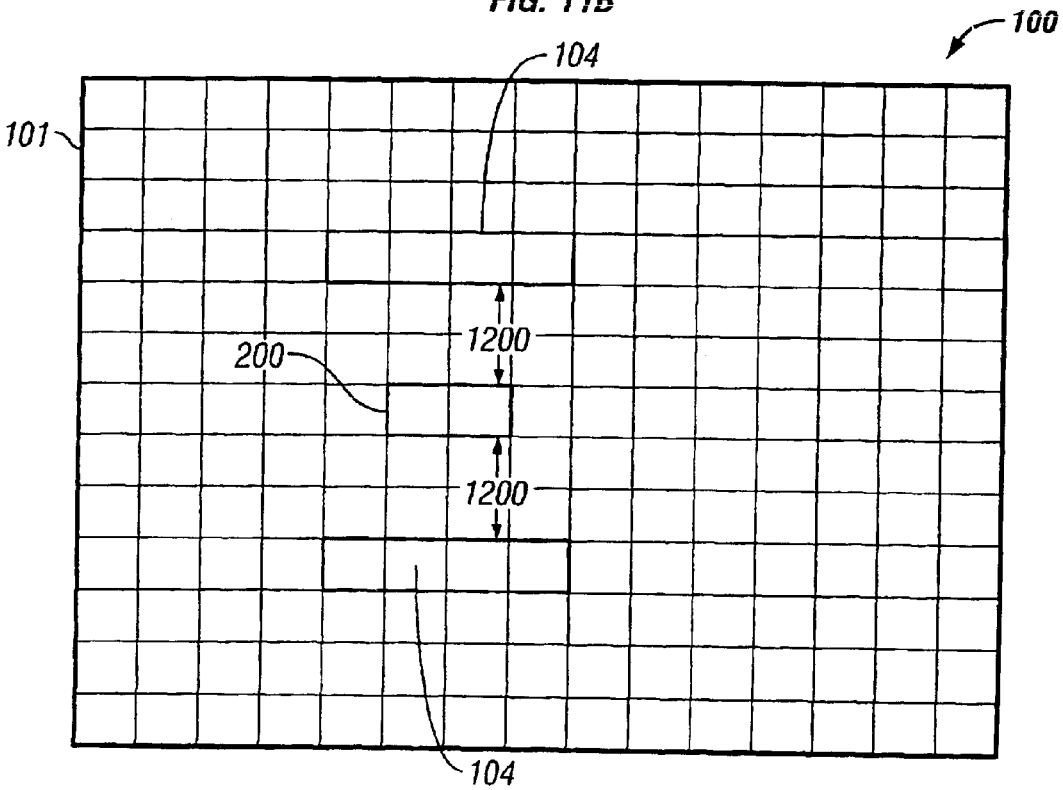
FIGS. 12*a* and 12*b* are plan views of the present invention planar antenna array illustrating phase relationships between the parasitic elements and the active element.
Figure 12B:
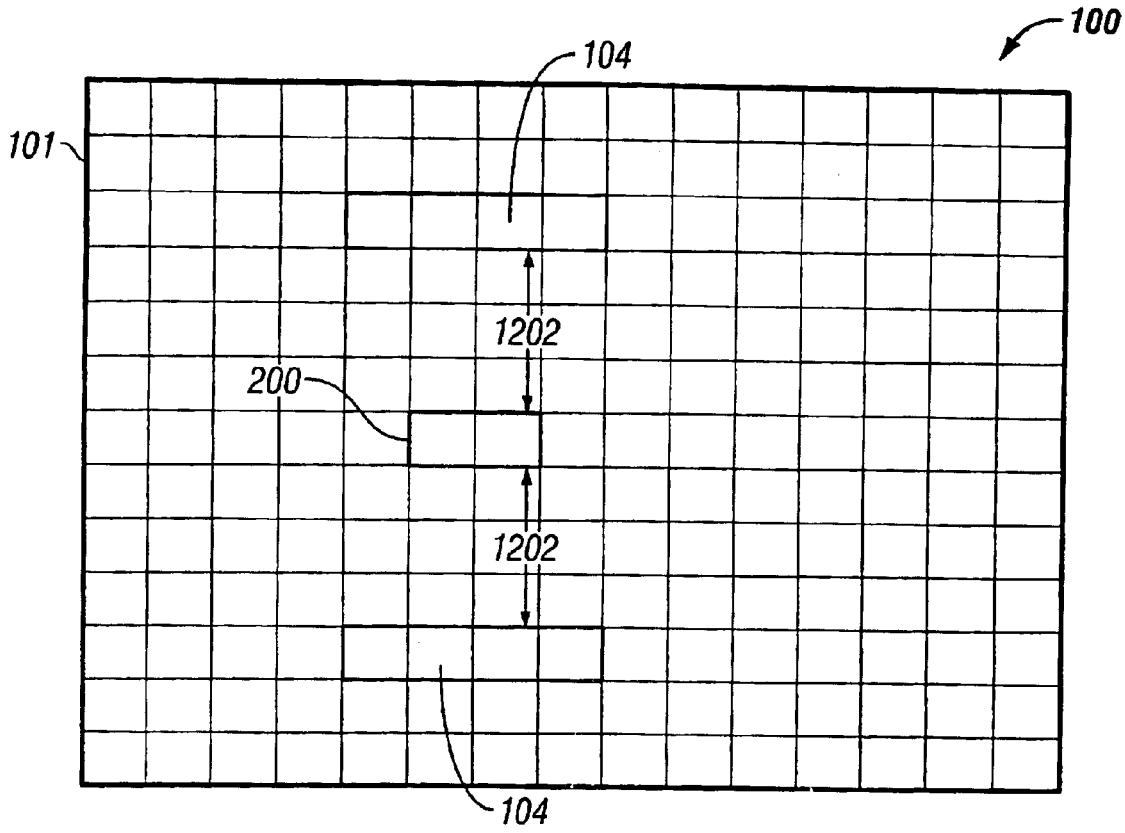

FIGS. 12*a* and 12*b* are plan views of the present invention planar antenna array illustrating phase relationships between the parasitic elements and the active element. As shown in FIG. 12*a*, a first lattice of parasitic elements 104 are separated from the active element 200 by a first distance 1200. As seen in FIG. 12*b*, a second lattice of parasitic elements 104 are separated from the active element 200 by a second distance 1202. Note that the lattices are not necessarily limited to two parasitic elements. Assuming that the active and parasitic element lengths, sizes, and general positions remain the same between the two figures, the two different distances result in a difference of phase between the parasitic elements and the active element, which results in beam shape variations. The concept is similar to a beam being shaped by a collection of connected active elements that are separated by a controlled degree of phase.

Figure 13:
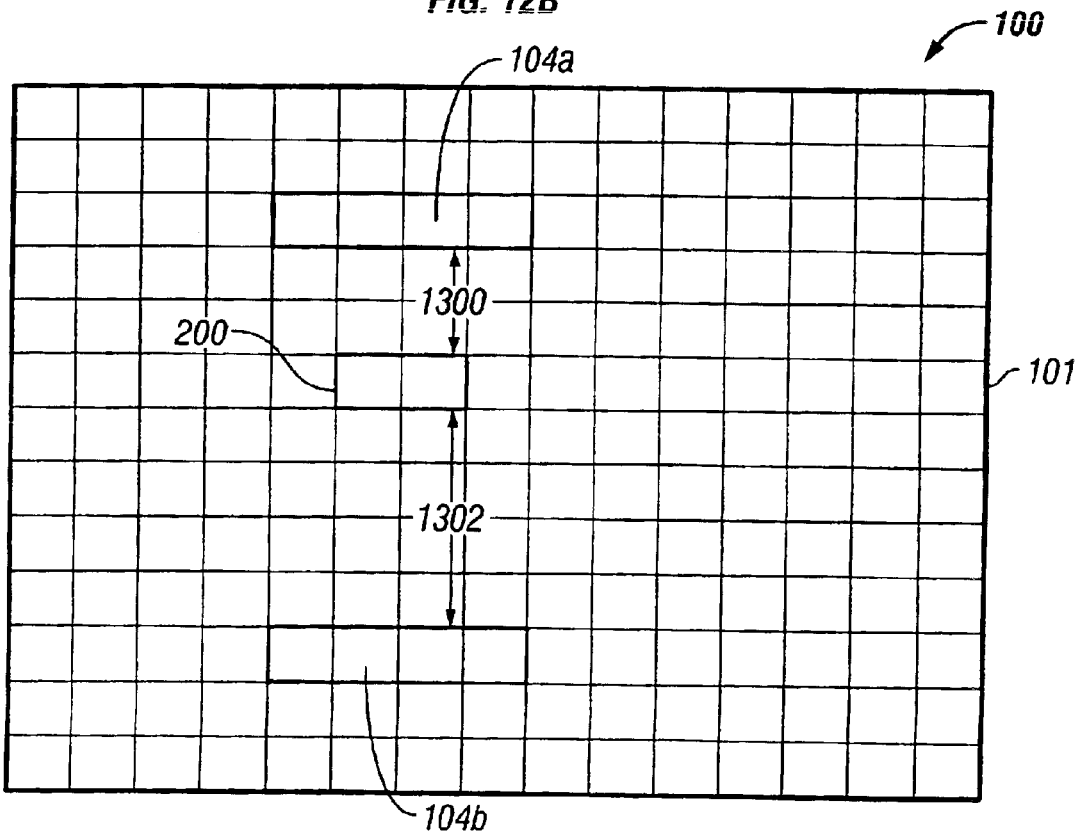
FIG. 13 is a plan view of the present invention planar antenna array illustrating a variation in lattice phase relationships.

FIG. 13 is a plan view of the present invention planar antenna array illustrating a variation in lattice phase relationships. In FIG. 13 the first lattice of parasitic elements includes a first parasitic element 104*a* separated from the active element 200 by a first distance 1300 and a second parasitic element 104*b* separated from the active element 200 by a second distance 1302. Note that the lattice may include more than two parasitic elements, where each parasitic element may have a different distance from the active element. Generally, it can be extrapolated from the above examples that a plurality of parasitic elements in a lattice are separated from the active element by a plurality of distances. To carry the extrapolation still further, a plurality of parasitic element lattices may be formed where each lattice includes a plurality of parasitic elements separated from the active element by a corresponding plurality of distances. That is, many lattices may be formed, where each lattice is differentiated from other lattices by the differences in distance as defined above.

Further note that although all the active and parasitic elements depicted in FIGS. 12*a*, 12*b*, and 13 are bisected in the same (horizontal) plane, the distance relationship between the active element and parasitic elements extends to lattices where the parasitic elements are bisected in different planes from each other and bisected in different planes from the active element. Further, the parasitic element lengths need not necessarily be parallely aligned with the active element length. Also note that although the concept of distance has been illustrated with a patch active element, similar distance relationships between parasitic elements and active elements exist for dipole and monopole active elements.

Figure 14:
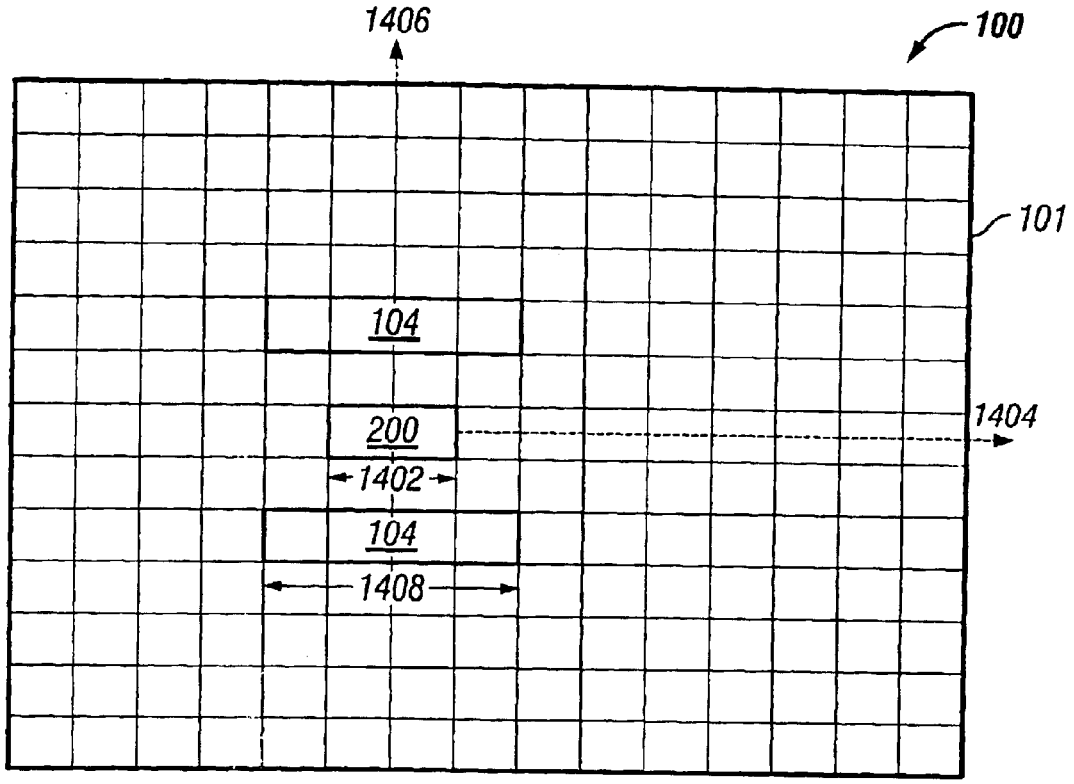
FIG. 14 is a plan view of the present invention planar antenna illustrating in greater detail a first set of exemplary positions of parasitic elements in a lattice.

FIG. 14 is a plan view of the present invention planar antenna illustrating in greater detail a first set of exemplary positions of parasitic elements in a lattice. The active element 200 has a length 1402 formed along a first vertical plane 1404 and bisected in a first horizontal plane 1406. A first lattice includes parasitic elements 104 having lengths 1408 parallely aligned to the active element length 1402 in the first vertical plane 1404 and bisected in the first horizontal plane 1406, in response to connecting their corresponding MEMS.

Figure 15:
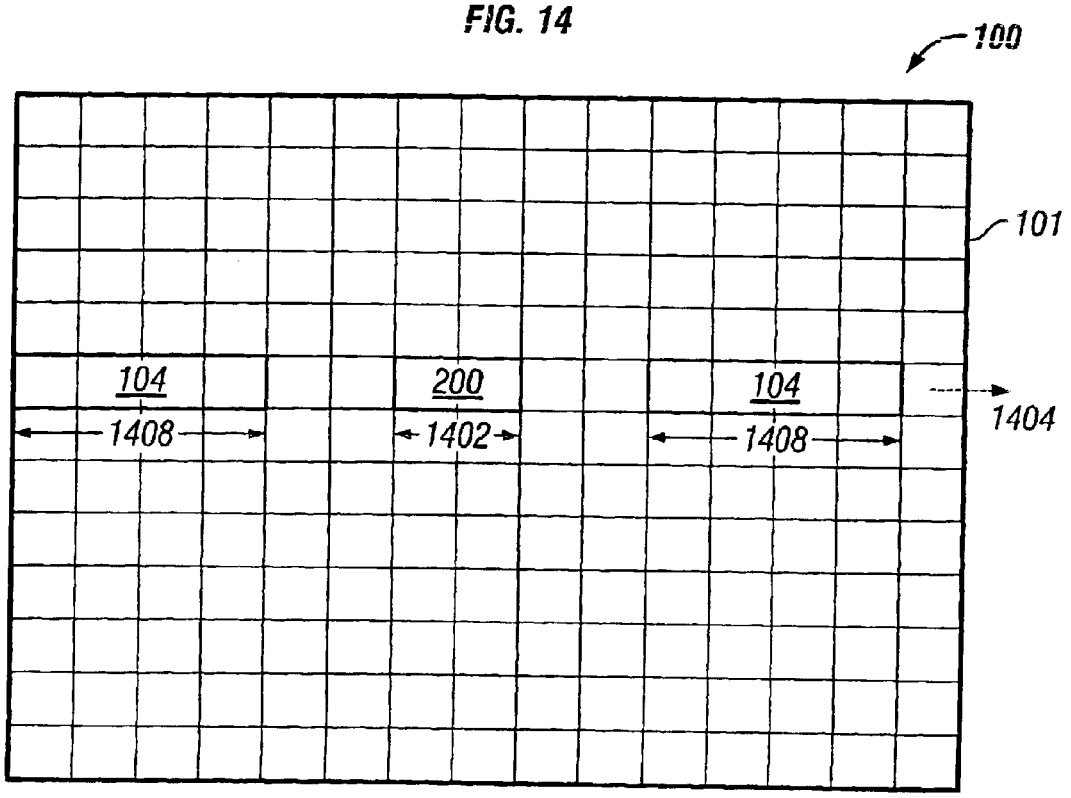
FIG. 15 is a plan view of the present invention planar antenna illustrating in greater detail a second set of exemplary positions of parasitic elements in a lattice.

FIG. 15 is a plan view of the present invention planar antenna illustrating in greater detail a second set of exemplary positions of parasitic elements in a lattice. The lattice includes parasitic elements 104 having lengths 1408 parallely aligned to the active element length 1402 in the first vertical plane 1404 and bisected in the first vertical plane 1404, in response to connecting their corresponding MEMS.

Figure 16:
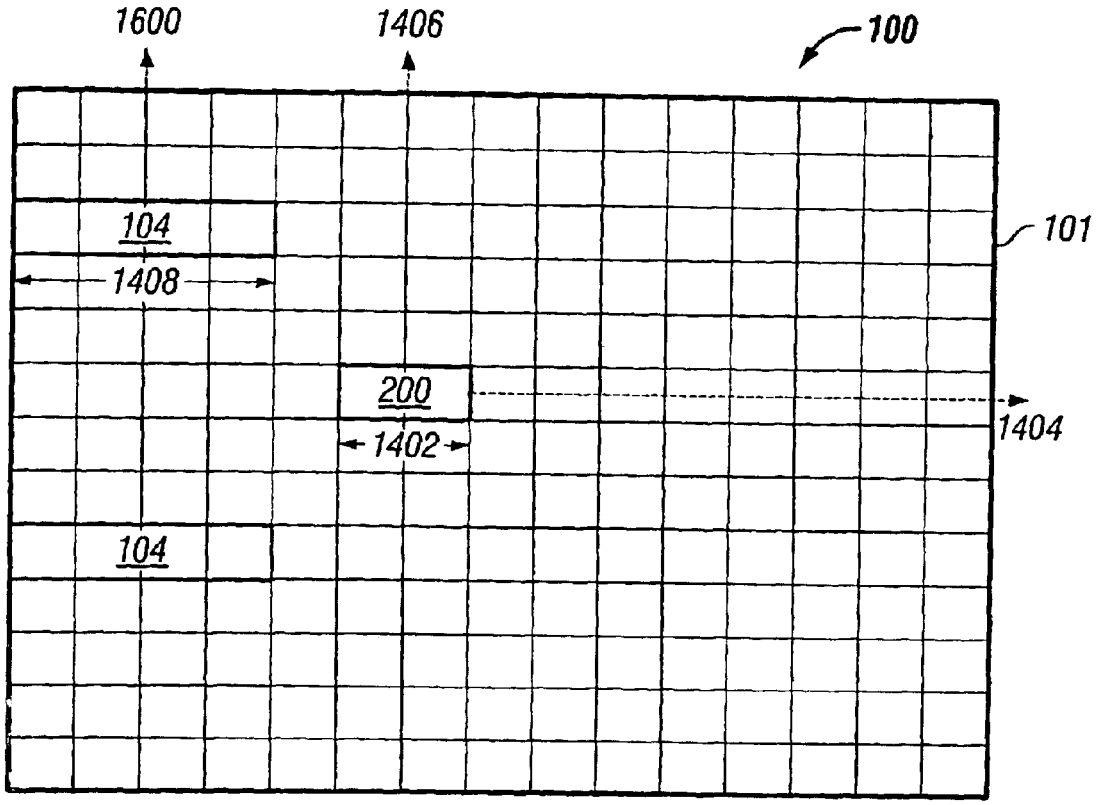
FIG. 16 is a plan view of the present invention planar antenna illustrating in greater detail a third set of exemplary positions of parasitic elements in a lattice.

FIG. 16 is a plan view of the present invention planar antenna illustrating in greater detail a third set of exemplary positions of parasitic elements in a lattice. The lattice includes parasitic elements 104 having lengths 1408 parallely aligned to the active element length 1402 in the first vertical plane 1404 and bisected in a second horizontal plane 1600, in response to connecting their corresponding MEMS.

Figure 17:
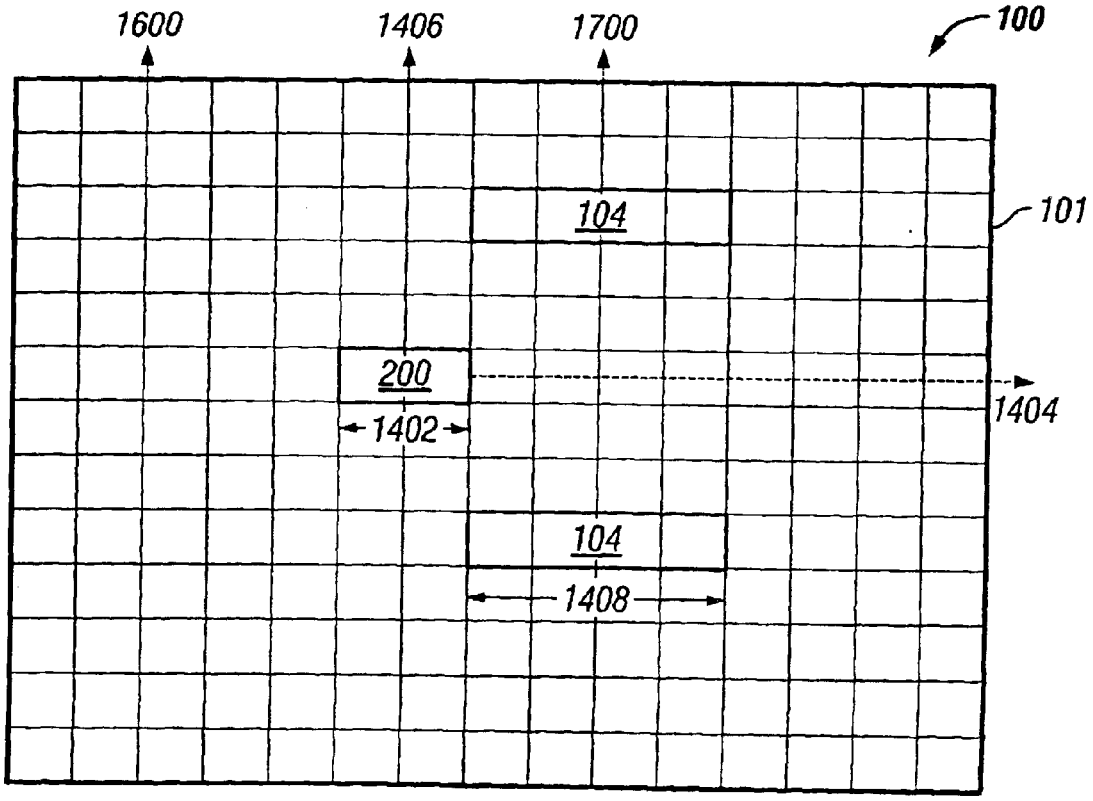
FIG. 17 is a plan view of the present invention planar antenna illustrating in greater detail a fourth set of exemplary positions of parasitic elements in a lattice.

FIG. 17 is a plan view of the present invention planar antenna illustrating in greater detail a fourth set of exemplary positions of parasitic elements in a lattice. The lattice includes parasitic elements 104 having lengths 1408 parallely aligned to the active element length 1402 in the first vertical plane 1404 and bisected in a third horizontal plane 1700, in response to connecting their corresponding MEMS.

Figure 18:
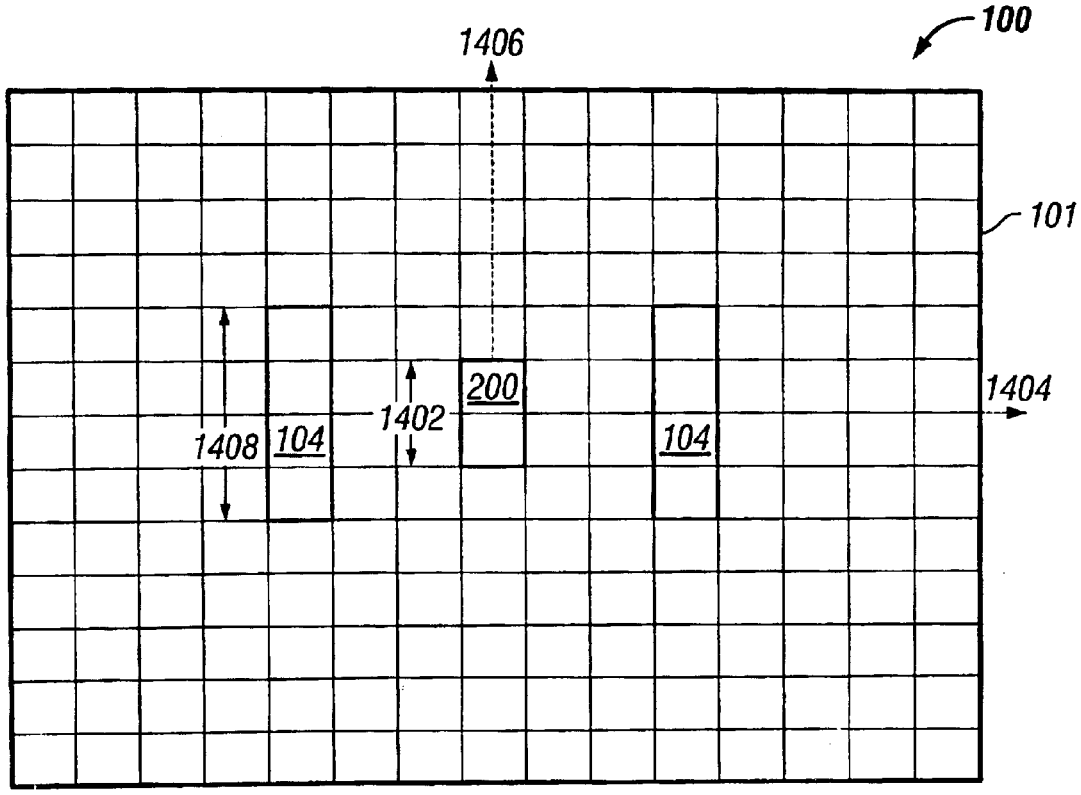
FIG. 18 is a plan view of the present invention planar antenna illustrating in greater detail a fifth set of exemplary positions of parasitic elements in a lattice.

FIG. 18 is a plan view of the present invention planar antenna illustrating in greater detail a fifth set of exemplary positions of parasitic elements in a lattice. The active element 200 has a length formed along the first horizontal plane 1406 and bisected in the first vertical plane 1404, in response to connecting their corresponding MEMS. The lattice includes parasitic elements 104 having lengths 1408 parallely aligned to the active element length 1402 in the first horizontal plane 1406 and bisected in the first vertical plane 1404, in response to connecting their corresponding MEMS.

Figure 19:
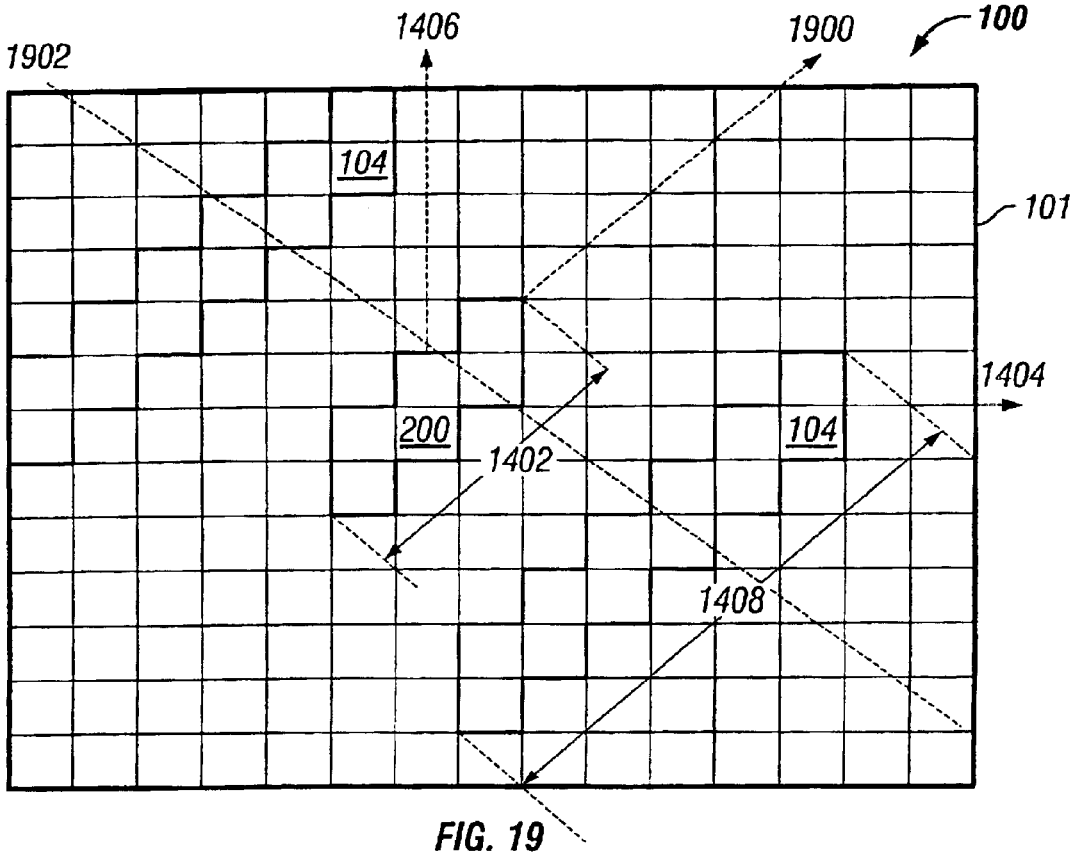
FIG. 19 is a plan view of the present invention planar antenna illustrating in greater detail a sixth set of exemplary positions of parasitic elements in a lattice.

FIG. 19 is a plan view of the present invention planar antenna illustrating in greater detail a sixth set of exemplary positions of parasitic elements in a lattice. The active element 200 has a length 1402 formed along a first diagonal plane 1900, between the first horizontal plane 1406 and first vertical plane 1404, and bisected in a second diagonal plane 1902, perpendicular to the first diagonal plane, in response to connecting their corresponding MEMS. Note that the first diagonal plane 1900 need not necessarily rotated 45 degrees from the first vertical plane. The lattice includes parasitic elements 104 having lengths 1408 parallely aligned to the active element length 1402 in the first diagonal plane 1900 and bisected in the second diagonal plane 1902, in response to connecting their corresponding MEMS.

Note that the antenna pattern generated by the antenna array of FIG. 19 is the same pattern shown in FIGS. 3*b* and 3*c*, except that the pattern depicted in FIG. 3*b* would be in a plane defined by diagonal 1902. The pattern depicted in FIG. 3*c* would be formed in the plane defined by diagonal 1900. The active element is polarized in the direction of diagonal 1900.

Figure 20:
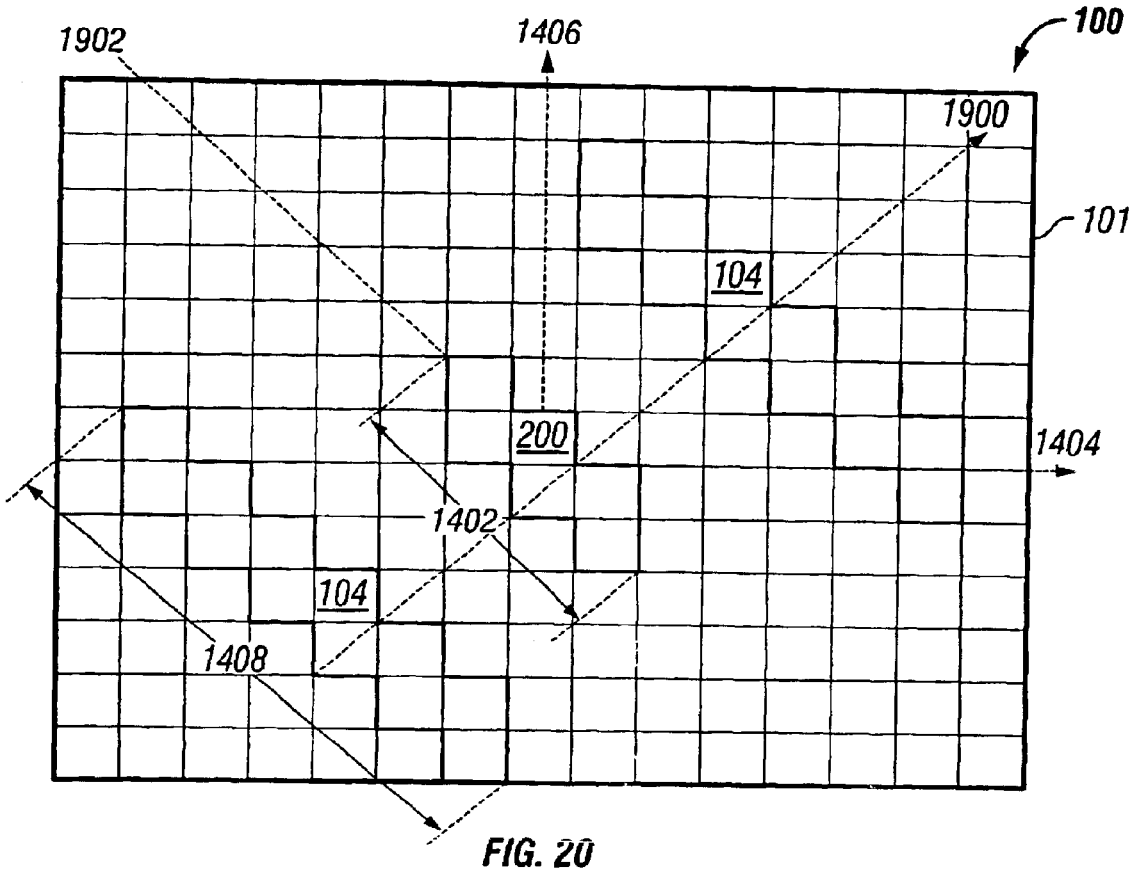
FIG. 20 is a plan view of the present invention planar antenna illustrating in greater detail a seventh set of exemplary positions of parasitic elements in a lattice.

FIG. 20 is a plan view of the present invention planar antenna illustrating in greater detail a seventh set of exemplary positions of parasitic elements in a lattice. The active element 200 has a length 1402 formed along the second diagonal plane 1902, and bisected in the first diagonal plane 1900, in response to connecting their corresponding MEMS. The lattice includes parasitic elements 104 having lengths 1408 parallely aligned to the active element length 1402 in the second diagonal plane 1902 and bisected in the first diagonal plane 1900, in response to connecting their corresponding MEMS.

Figure 21:
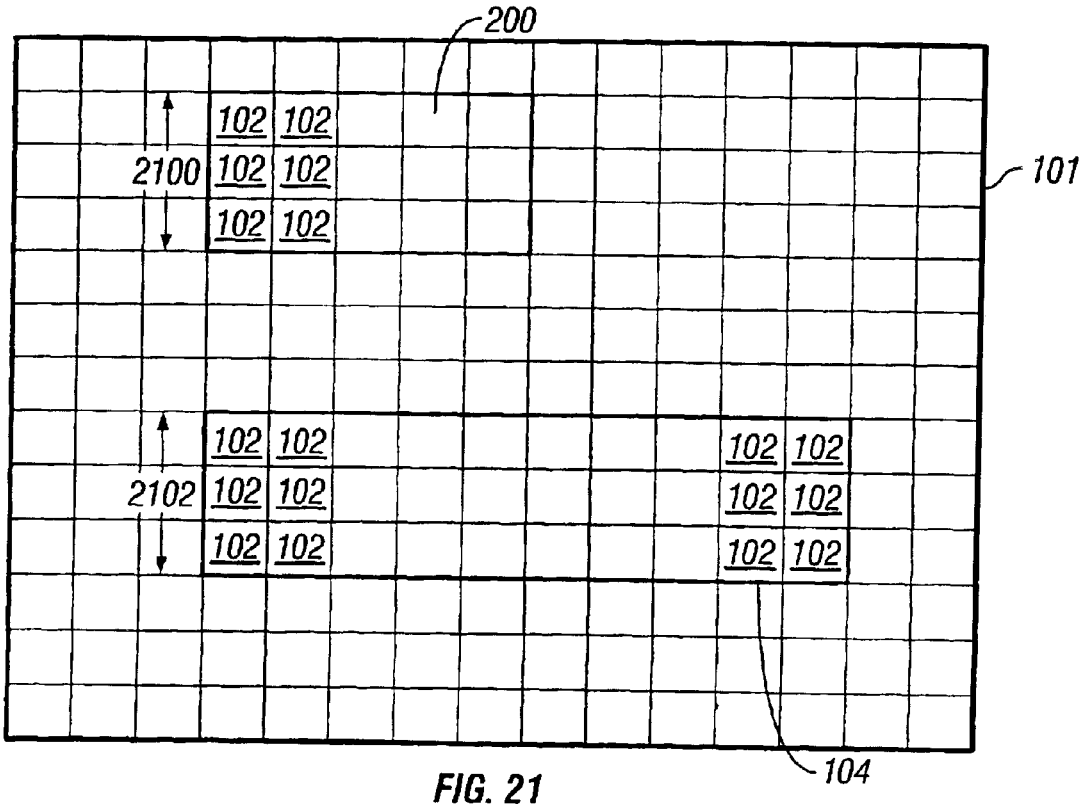
FIG. 21 is a plan view depicting an active element and parasitic element in detail.

FIG. 21 is a plan view depicting an active element and parasitic element in detail. As shown, the active element 200 has a width 2100 and a plurality of MEMSs 102 parallely aligned along the width 2100. Three MEMS 102 are shown parallely aligned, however, the present invention is not limited to any particular number. Likewise, each parasitic element 104 (one is shown) has a width 2102 and includes a plurality of MEMSs 102 parallely aligned along the width 2102.

Figure 22:
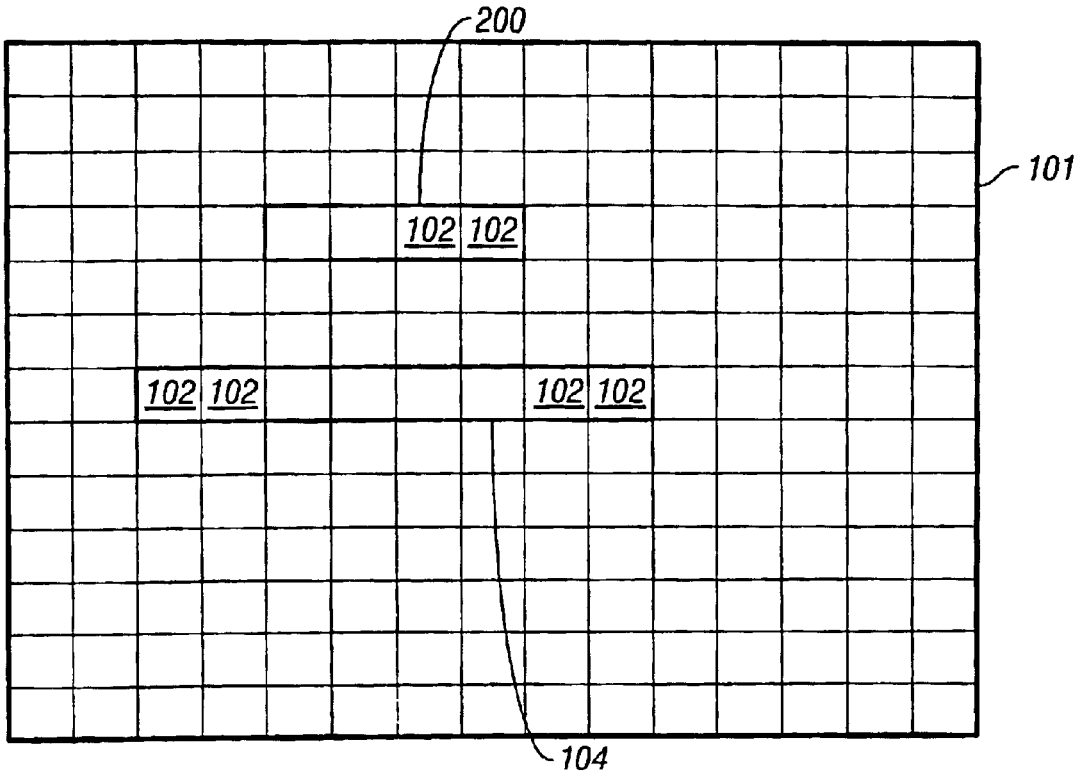
FIG. 22 is a plan view depicting another active element and parasitic element in detail.

FIG. 22 is a plan view depicting another active element and parasitic element in detail. The active element 200 has a length 2200 and a plurality of MEMSs 102 aligned along the radiator length 2200. Two MEMS 102 are shown aligned along the length. Each parasitic element 104 (one is shown) has a length 2202 and a plurality of MEMSs aligned along the length 2202. Two sets of two MEMS are shown aligned along the length, however, the invention is not limited to any particular number. In some aspects of the invention, MEMS 102 are simultaneously aligned along both the lengths and widths of the elements 102/104 as shown in FIG. 21.

Figure 28:
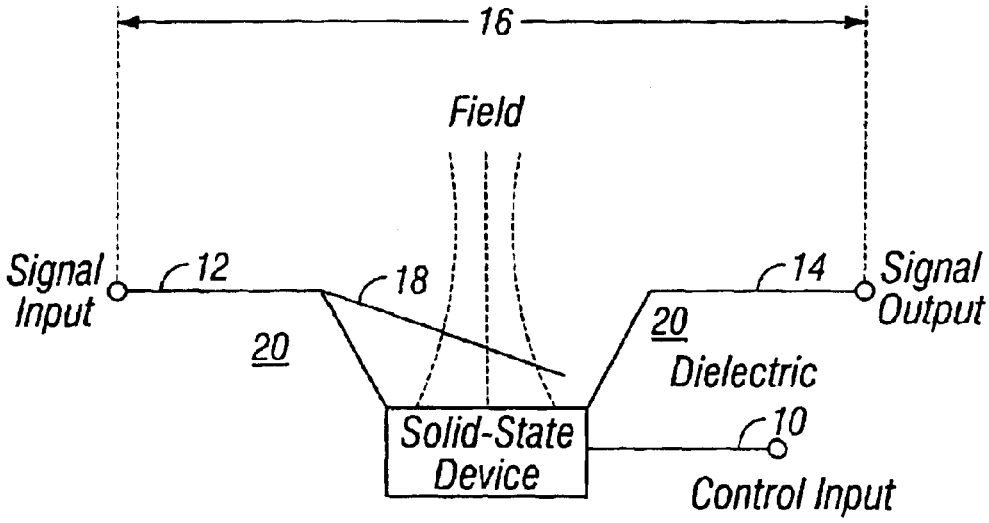
FIG. 28 (Prior Art)
FIG. 28 is a schematic diagram of a microelectromechanical switch (MEMS) (prior art).

Returning briefly to FIG. 28, it can be seen that each MEMS has a control input 10, a signal input 12, and a signal output 14 selectively connected to the signal input 12 in response to a control signal. The MEMS has a mechanical length 16 responsive to connecting its corresponding MEMS conductive section 18. In some aspects, the signal input 12 and/or signal output 14 may contribute nothing to the overall length 16 of the MEMS. A similar analysis applies to the MEMS width. As shown, the signal input 12 and signal output 14 sections are made of conductive sections that are considered in the overall length 16 of the MEMS. Alternately stated, each MEMS includes a dielectric layer 20 and a conductive line (12 and 14), with a selectively connectable MEMS conductive section 18, formed overlying the dielectric layer 20.

Figure 23:
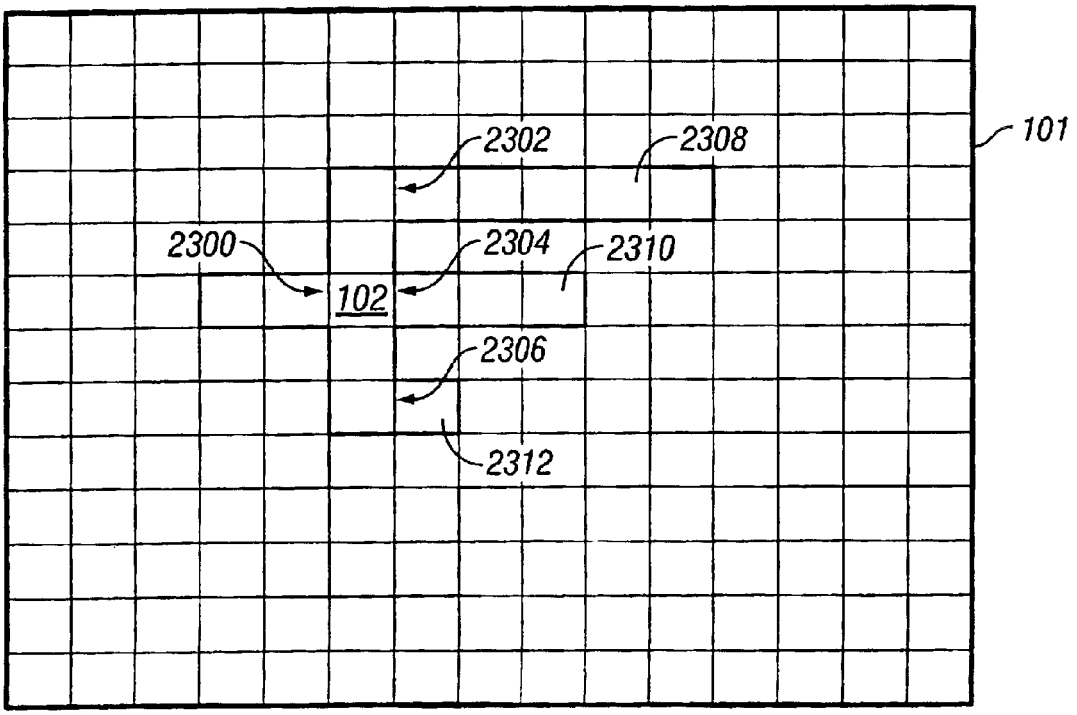
FIG. 23 is a plan view of the present invention planar antenna illustrating a variation using a MEMS with multiple signal outputs.

FIG. 23 is a plan view of the present invention planar antenna illustrating a variation using a MEMS with multiple signal outputs. An element, either active or parasitic is shown formed with a MEMS (partially defined by the dotted lines) having a signal input 2300, and a plurality of signal outputs, with one of the signal outputs selectively connected to the signal input in response to the control signal. A control input also exists but is not shown. Using such a MEMS, an element can be formed that has a selectable length, for operation at different frequencies. As shown, the element can be formed into three electrical lengths, however, the present invention is not limited to any particular number.

Alternately stated, an active element may have a first plurality of fixed-length conductive sections. In this example the first plurality is equal to three and conductive sections 2308, 2310, and 2312 are shown connected to a first plurality of MEMS signal outputs. That is, conductive section 2308 is connected to MEMS signal output 2302, conductive section 2310 is connected to MEMS signal output 2304, and conductive section 2312 is connected to MEMS signal output 2306. The active element has an effective length of an odd multiple of a quarter-wavelength at the first plurality of frequencies in response to connecting one of the first plurality of radiator fixed length conductive sections through the radiator MEMS. Note that the conductive sections may include additional MEMS (not shown) to create a greater selection of element lengths.

In a similar manner, each parasitic element could include a first plurality of fixed-length conductive sections connected to a first plurality of signal outputs of their corresponding MEMS. Each parasitic element could have an effective length of an odd multiple of a quarter-wavelength at the first plurality of frequencies in response to connecting one of the first plurality of fixed length conductive sections through their corresponding MEMS.

Figure 24:
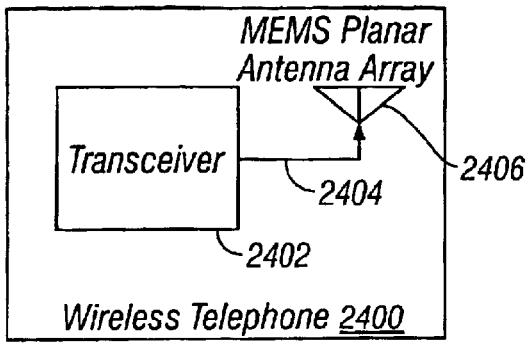
FIG. 24 is a schematic block diagram illustrating the present invention wireless telephone communications device.

FIG. 24 is a schematic block diagram illustrating the present invention wireless telephone communications device. The wireless communications device 2400 comprises a transceiver 2402, as defined above, with an antenna port on line 2404 and a MEMS planar antenna array 2406, as described above. The planar antenna array 2406 comprises an active element and a lattice of parasitic elements including selectively connectable MEMSs. Alternately, the planar antenna array 2406 includes an active element with a selectively connectable MEMS, where the parasitic elements are not necessary formed using MEMS sections. In other aspects, both the active and parasitic elements are formed with MEMS.

In one aspect of the device 2400, the active element is a dipole. In another aspect, it is a monopole. In yet another aspect, the active element is a patch antenna. The antenna array 2406 communicates at frequencies such as 824 to 894 megahertz (MHz), 1850 to 1990 MHz, 1565 to 1585 MHz, and 2400 to 2480 MHz. The transceiver 2402 can be a telephone transceiver, a global positioning system (GPS) receiver, or a Bluetooth transceiver.

Figure 25:
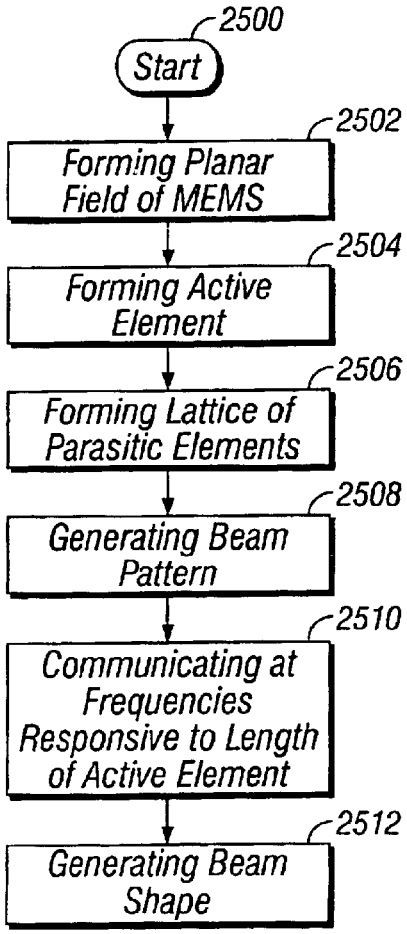
FIG. 25 is a flowchart illustrating the present invention method for forming an antenna array.

FIG. 25 is a flowchart illustrating the present invention method for forming an antenna array. Although the method of FIG. 25, and FIGS. 26 and 27 below, are depicted as a sequence of numbered steps for clarity, no order should be inferred from the numbering unless explicitly stated. It should be understood that some of these steps may be skipped, performed in parallel, or performed without the requirement of maintaining a strict order of sequence. The method starts at Step 2500.

Step 2502 forms a planar field of microelectromechanical switches (MEMSs). Step 2504 forms an active element. Step 2506 forms a lattice of parasitic elements from the field of MEMSs. Step 2508 generates an antenna array beam pattern in response to forming the lattice of parasitic elements.

In some aspects of the method, forming an active element in Step 2504 includes forming a planar active element from the field of MEMSs. Then, forming the planar active element from the field of MEMSs includes forming an active element having an electrical length selected from a plurality of electrical lengths. In response, the method comprises an additional step. Step 2510 electromagnetically communicates at a frequency responsive to the electrical length of the active element. With respect to a wireless telephone device, Step 2510 includes communicating at a frequency such as 824 to 894 MHz, 1850 to 1990 MHz, 1565 to 1585 MHz, or 2400 to 2480 MHz.

In some aspects, forming the planar active element from the field of MEMSs in Step 2504 includes forming an active element having a position (as defined above) in the field of MEMSs. Likewise, Step 2504 may include forming an active element having a shape (as defined above) selected from a plurality of shapes.

Similarly, forming the lattice of parasitic elements from the field of MEMSs in Step 2506 includes forming a lattice with a first plurality of parasitic elements having a second plurality of electrical lengths. Step 2506 may include forming parasitic elements having positions in the field of MEMSs, and/or shapes selected from a plurality of shapes. Further, Step 2506 may include forming a lattice with a first plurality of parasitic elements having a second plurality of phase relationship from the active element. This phase relationship is related to the description of the distance between parasitic elements and the active element made above. Then, the method comprises a further step. Step 2512 generates an antenna array beam shape in response to second plurality of phase relationships.

Figure 26:
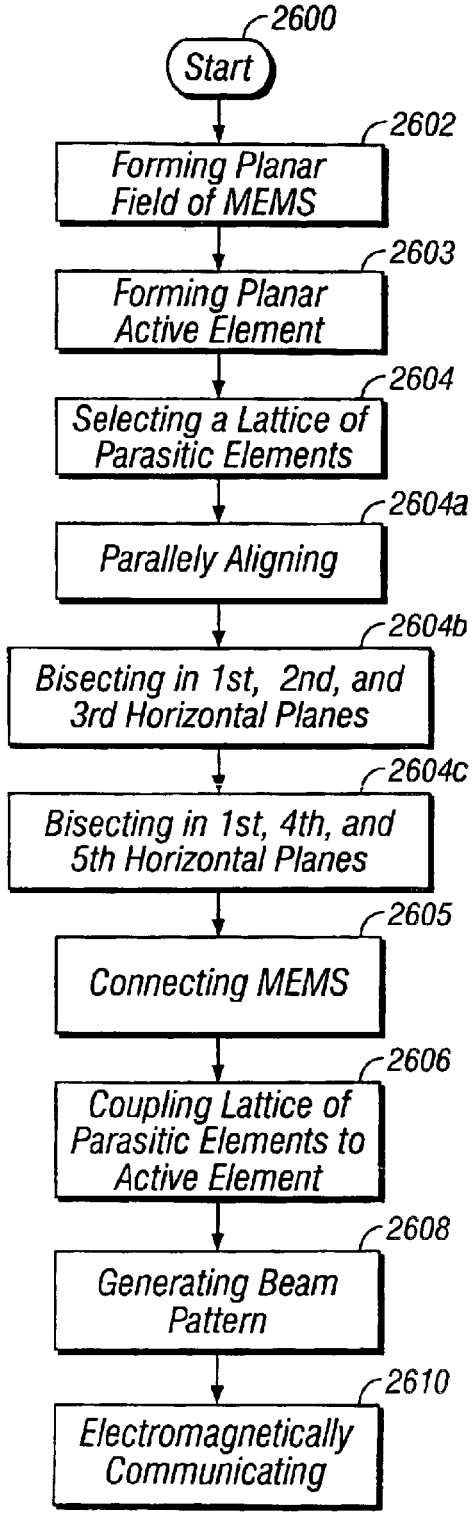
FIG. 26 is a flowchart illustrating a variation of the method for forming an antenna array described in FIG. 25.

FIG. 26 is a flowchart illustrating a variation of the method for forming an antenna array described in FIG. 25. The method starts at Step 2600. Step 2602 forms a planar field of microelectromechanical switches (MEMSs). Step 2603 forms a planar active element. Step 2604, from the planar field of MEMSs, selects a lattice of parasitic elements. Step 2605 connects a MEMS. Step 2606, in response to connecting a MEMS, couples the selected lattice of parasitic elements to the antenna active element. Step 2608 generates an antenna array beam pattern in response to the coupling.

In some aspects, forming a planar active element includes selecting the planar active element from the field of MEMSs. In some aspects, forming the planar active element from the field of MEMSs includes selecting an active element having an electrical length selected from a plurality of electrical lengths. Then, the method includes a further step. Step 2610 electromagnetically communicates at a frequency responsive to the electrical length of the active element. In some aspects, electromagnetically communicating includes communicating at a frequency selected from the group including 824 to 894 megahertz (MHz), 1850 to 1990 MHz, 1565 to 1585 MHz, and 2400 to 2480 MHz.

In some aspects of the method, selecting the lattice of parasitic elements from the field of MEMSs in Step 2604 includes selecting parasitic element electrical lengths. In other aspects, Step 2604 selects parasitic element positions defined with respect to the active element.

In some aspects, selecting parasitic element positions defined with respect to the active element in Step 2604 includes selecting first positions as follows. Step 2604*a* parallely aligns an active element length with first and second parasitic element lengths. For example, see FIG. 3*a* where the parasitic elements lengths are aligned with the active element length. Step 2604*b* bisects the active element length in a first horizontal plane, the first parasitic element length in a second horizontal plane, and the second parasitic element in a third horizontal plane. Using FIG. 3*a* as an example again, the first, second, and third horizontal planes are the same. Then, generating an antenna array beam pattern in response to the coupling in Step 2608 includes generating a first beam pattern response to the relationship between the first, second, and third horizontal planes. For example, see the beam pattern depicted in FIG. 3*b*, orthogonal to the first horizontal plane.

In other aspects, selecting parasitic element positions defined with respect to the active element includes selecting second positions as follows. Step 2604*c* bisects the first parasitic element length in a fourth horizontal plane and the second parasitic element in a fifth horizontal plane, different than the fourth horizontal plane. For example, see FIG. 5 where each element is bisected in a different horizontal plane. Then, generating an antenna array beam pattern in response to the coupling in Step 2608 includes generating a second beam pattern that is rotated with respect to the first beam pattern.

In some aspects, Step 2604 selects parasitic element shapes. In further aspects, Step 2604 selects the distance between parasitic elements and the active element. The distance can affect the beam width and shape. For example, selecting the distance between parasitic elements and the active element in Step 2604 includes locating first and second parasitic elements a first distance from the active element. Then, generating an antenna array beam pattern in response to the coupling in Step 2608 includes generating a first beam pattern with a beam width responsive to the first distance. For example, see the beam pattern of FIG. 3*b*.

Likewise, selecting the distance between parasitic elements and the active element in Step 2604 may includes locating first and second parasitic elements a second distance from the active element, greater than the first distance. Then, generating an antenna array beam pattern in response to the coupling in Step 2608 includes generating a second beam pattern with a beam width narrower than the first beam width.

Alternately, selecting the distance between parasitic elements and the active element in Step 2604 includes locating the first parasitic elements a second distance from the active element, greater than the first distance. Thus, the phase relationship of the two parasitic elements, measured with respect to the active element, is different. Then, generating an antenna array beam pattern in response to the coupling in Step 2608 includes generating a third beam pattern that is rotated with respect to the first beam pattern.

In some aspects, selecting the lattice of parasitic elements from the field of MEMSs in Step 2604 includes selecting the number of parasitic elements.

Figure 27:
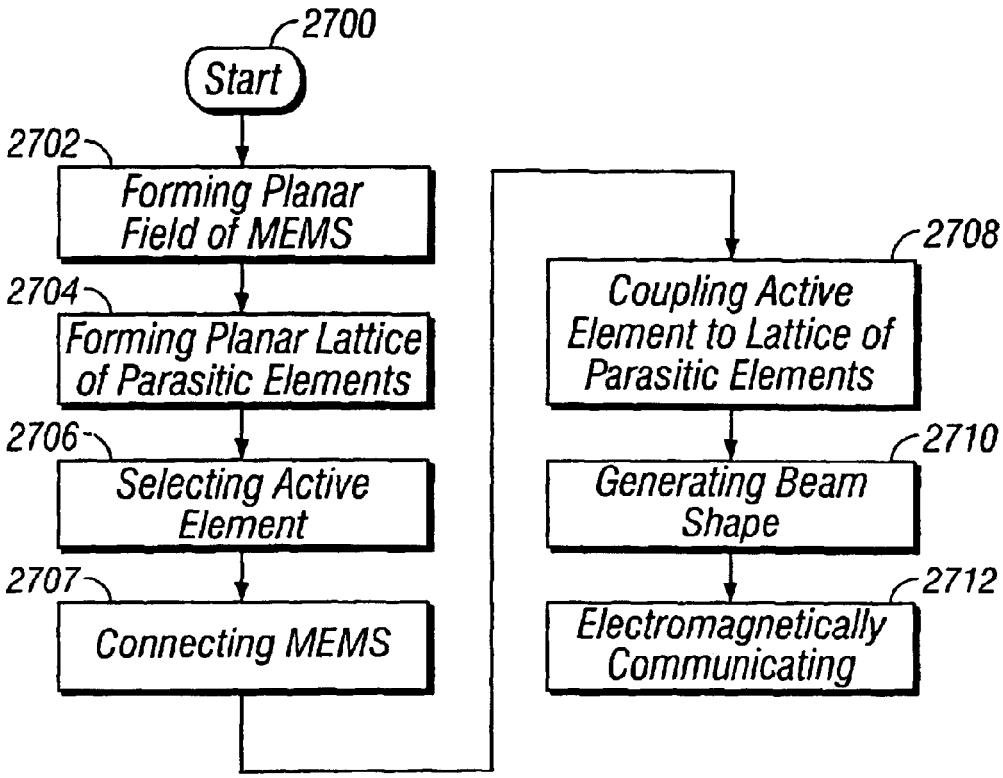
FIG. 27 is a flowchart illustrating another variation of the method for forming an antenna array described in FIG. 25.

FIG. 27 is a flowchart illustrating another variation of the method for forming an antenna array described in FIG. 25. The method starts at Step 2700. Step 2702 forms a planar field of microelectromechanical switches (MEMSs). Step 2704 forms a planar lattice of parasitic elements. Step 2706, from the planar field of MEMSs, selects an active element. Step 2707 connects a MEMS. Step 2708, in response to connecting a MEMS, couples the selected active element to a lattice of parasitic elements. Step 2710 generates an antenna array beam pattern in response to the coupling.

In some aspects of the method, forming a planar lattice of parasitic elements in Step 2704 includes selecting the planar lattice of parasitic elements from the field of MEMSs.

In other aspects, selecting the active element from the field of MEMSs in Step 2706 includes selecting an active element having an electrical length selected from a plurality of electrical lengths. Then, the method includes a further step. Step 2712 electromagnetically communicates at a frequency responsive to the electrical length of the active element. In some aspects, electromagnetically communicating includes communicating at a frequency selected from the group including 824 to 894 megahertz (MHz), 1850 to 1990 MHz, 1565 to 1585 MHz, and 2400 to 2480 MHz.

In other aspects, selecting the active element from the field of MEMSs in Step 2706 includes selecting an active element position in the planar field of MEMSs. In some aspects, Step 2706 includes selecting active element shapes. In other aspects, Step 2706 includes selecting patch, monopole, or dipole active element.

A MEMS planar antenna array, and a method of forming a MEMS planar antenna array have been provided. A few examples have been given detailing element shapes and the positioning of elements with respect to each other. It should be understood that a huge variety of alternate shapes and positions could be developed from the above description and extrapolated from the associated drawings. Although not all of the present invention antenna array physical characteristics have been specifically described, it would be within the skill of one skilled in the art to fabricate the invention in one of many silicon-based technologies. Other variations of the invention will occur to those skilled in the art.

I claim:

1. A microelectromechanical switch (MEMS) planar antenna array comprising:

a selectively connectable MEMS;

a first planar parasitic element, electrically coupled to the selectively connectable MEMS, having reconfigurable sizes and locations;

a second planar parasitic element, electrically coupled to the selectively connectable MEMS, having reconfigurable sizes and locations;

a planar active element proximate the planar parasitic element;

a transceiver port coupled to the planar active element.

2. The planar antenna array of claim 1 wherein the active element includes a selectively connectable MEMS.

3. The planar antenna array of claim 2 wherein the active element has reconfigurable sizes and locations.

4. The planar antenna array of claim 2 wherein the active element is a dipole and includes:

a radiator having an effective length of an odd multiple of a quarter-wavelength at a first frequency responsive to connecting a radiator MEMS and an effective length of an odd multiple of a quarter-wavelength at a second frequency responsive to disconnecting the radiator MEMS; and, a counterpoise having an effective length of an odd multiple of a quarter-wavelength at the first frequency responsive to connecting a counterpoise MEMS and an effective length of an odd multiple of a quarter-wavelength at a second frequency responsive to disconnecting the counterpoise MEMS; and, wherein each parasitic element has an effective length of an odd multiple of a half-wavelength at the first frequency responsive to connecting their corresponding MEMS and an effective length of an odd multiple of a half-wavelength odd multiple length at a second frequency responsive to disconnecting their corresponding MEMS.

5. The planar antenna array of claim 2 wherein the active element is a monopole and include:

a radiator having an effective length of an odd multiple of a quarter-wavelength at a first frequency responsive to connecting a radiator MEMS and an effective length of an odd multiple of a quarter-wavelength at a second frequency responsive to disconnecting the radiator MEMS; and, a planar counterpoise groundplane; and, wherein the parasitic elements are connected to the counterpoise and have an effective length of an odd multiple of a quarter-wavelength at the first frequency in response to connecting their corresponding MEMS and an effective length of an odd multiple of a quarter-wavelength at a second frequency responsive to disconnecting their corresponding MEMS.

6. The planar antenna array of claim 2 wherein the active element is a dipole and includes:

a radiator having an effective length of an odd multiple of a quarter-wavelength at a first plurality of frequencies in response to connecting a second plurality of radiator MEMSs; and, a counterpoise having an effective length of an odd multiple of a quarter-wavelength at the first plurality of frequencies in response to connecting a second plurality of counterpoise MEMSs;

wherein each parasitic element has an effective length of an odd multiple of a half-wavelength at the first plurality of frequencies in response to connecting their corresponding second plurality of MEMS.

7. The planar antenna array of claim 2 wherein the active element is a monopole and includes:

a radiator having an effective length of an odd multiple of a quarter-wavelength at a first plurality of frequencies in response to connecting a second plurality of radiator MEMSs; and, a planar counterpoise groundplane; and, wherein the parasitic elements are connected to the counterpoise and have an effective length of an odd multiple of a quarter-wavelength at the first plurality of frequencies in response to connecting their corresponding MEMS.

8. The planar antenna array of claim 1 wherein each MEMS includes:

a dielectric layer; and, a conductive line, with a selectively connectable MEMS conductive section, formed overlying the dielectric layer.

9. The planar antenna array of claim 1 further comprising:

a planar counterpoise;

a dielectric layer overlying the counterpoise; and, wherein the active element is a patch antenna overlying the dielectric layer.

10. The planar antenna array of claim 1 wherein the active element is an antenna selected from the group including dipole and monopole antennas.

11. The planar antenna array of claim 1 wherein the parasitic elements have a distance from the active element that is formed in response to selectively connecting MEMS in the field.

12. The planar antenna array of claim 1 wherein the parasitic elements have a position with respect to the active element that is formed in response to selectively connecting MEMS in the field.

13. The planar antenna array of claim 1 wherein the parasitic elements have a length that is formed in response to selectively connecting MEMS in the field.

14. The planar antenna array of claim 1 further comprising:

a plurality of conductive sections interposed between a plurality of MEMS; and, wherein the parasitic elements are formed from a plurality of MEMS and conductive sections.

15. The planar antenna array of claim 1 further comprising:

a first lattice of parasitic elements, wherein the first lattice of parasitic elements are separated from the active element by a first distance; and, a second lattice of parasitic elements, wherein the second lattice of parasitic elements are separated from the active element by a second distance.

16. The planar antenna array of claim 15 wherein a plurality of parasitic element lattices may be formed, where each lattice includes a plurality of parasitic elements separated from the active element by a corresponding plurality of distances.

17. The planar antenna array of claim 15 wherein the active element has a length formed along a first vertical plane and bisected in a first horizontal plane; and, wherein the first lattice includes parasitic elements having lengths parallely aligned to the active element length in the first vertical plane and bisected in the first horizontal plane, in response to connecting their corresponding MEMS.

18. The planar antenna array of claim 15 wherein the lattice includes parasitic elements having lengths parallely aligned to the active element length in the first vertical plane and bisected in the first vertical plane, in response to connecting their corresponding MEMS.

19. The planar antenna array of claim 15 wherein the lattice includes parasitic elements having lengths parallely aligned to the active element length in the first vertical plane and bisected in a second horizontal plane, in response to connecting their corresponding MEMS.

20. The planar antenna array of claim 15 wherein the lattice includes parasitic elements having lengths parallely aligned to the active element length in the first vertical plane and bisected in a third horizontal plane, in response to connecting their corresponding MEMS.

21. The planar antenna array of claim 15 wherein the active element has a length formed along the first horizontal plane and bisected in the first vertical plane, in response to connecting their corresponding MEMS; and, wherein the lattice includes parasitic elements having lengths parallely aligned to the active element length in the first horizontal plane and bisected in the first vertical plane, in response to connecting their corresponding MEMS.

22. The planar antenna array of claim 15 wherein the active element has a length formed along a first diagonal plane, between the first horizontal and vertical planes, and bisected in a second diagonal plane, perpendicular to the first diagonal plane, in response to connecting their corresponding MEMS and, wherein the lattice includes parasitic elements having lengths parallely aligned to the active element length in the first diagonal plane and bisected in the second diagonal plane, in response to connecting their corresponding MEMS.

23. The planar antenna array of claim 15 wherein the active element has a length formed along the second diagonal plane, and bisected in the first diagonal plane, in response to connecting their corresponding MEMS; and, wherein the lattice includes parasitic elements having lengths parallely aligned to the active element length in the second diagonal plane and bisected in the first diagonal plane, in response to connecting their corresponding MEMS.

24. The planar antenna array of claim 1 wherein the active element has a width and a plurality of MEMSs parallely aligned along the width; and, wherein each parasitic element has a width and includes a plurality of MEMSs parallely aligned along the width.

25. The planar antenna array of claim 1 wherein the active element has a length and a plurality of MEMSs aligned along the length; and, wherein each parasitic element has a length and a plurality of MEMSs aligned along the length.

26. The planar antenna array of claim 1 wherein the MEMS has a control input, a signal input, and a plurality of signal outputs, with one of the signal outputs selectively connected to the signal input in response to the control signal.

27. The planar antenna array of claim 26 wherein the active element includes a first plurality of fixed-length conductive sections connected to a first plurality of MEMS signal outputs, the radiator having an effective length of an odd multiple of a quarter-wavelength at the first plurality of frequencies in response to connecting one of the first plurality of radiator fixed length conductive sections through the radiator MEMS; and, wherein each parasitic element includes a first plurality of fixed-length conductive sections connected to a first plurality of signal outputs of their corresponding MEMS, each parasitic element having an effective length of an odd multiple of a quarter-wavelength at the first plurality of frequencies in response to connecting one of the first plurality of fixed length conductive sections through their corresponding MEMS.

28. The planar antenna array of claim 1 wherein the antenna array is coupled to a wireless communication system base station.

29. A microelectromechanical switch (MEMS) planar antenna array comprising:

a selectively connectable MEMS;

a first planar active element, electrically coupled to the selectively connectable MEMS, and having reconfigurable sizes and locations;

a second planar active element, electrically coupled to the selectively connectable MEMS, and having reconfigurable sizes and locations;

a transceiver port coupled to the first or second planar active element.

30. The planar antenna array of claim 29 wherein each MEMS includes:

a dielectric layer; and, a conductive line, with a selectively connectable MEMS conductive section, formed overlying the dielectric layer.

31. The planar antenna array of claim 29 further comprising:

a planar counterpoise;

a dielectric layer overlying the counterpoise; and, wherein the active element is a patch antenna overlying the dielectric layer.

32. The planar antenna array of claim 29 wherein the active element is an antenna selected from the group including dipole and monopole antennas.

33. The planar antenna array of claim 29 further comprising:

a planar parasitic element proximate the first planar active element.

34. The planar antenna array of claim 29 wherein the active elements have a length that is formed in response to selectively connecting MEMS in the field.

35. The planar antenna array of claim 29 further comprising:

a plurality of conductive sections interposed between a plurality of MEMS; and, wherein the active elements are formed from a plurality of MEMS and conductive sections.

36. The planar antenna array of claim 29 wherein the active element is a dipole and includes:

a radiator having an effective length of an odd multiple of a quarter-wavelength at a first frequency responsive to connecting a radiator MEMS and an effective length of an odd multiple of a quarter-wavelength at a second frequency responsive to disconnecting the radiator MEMS; and, a counterpoise having an effective length of an odd multiple of a quarter-wavelength at the first frequency responsive to connecting a counterpoise MEMS and an effective length of an odd multiple of a quarter-wavelength at a second frequency responsive to disconnecting the counterpoise MEMS.

37. The planar antenna array of claim 29 wherein the active element is a monopole and includes:

a radiator having an effective length of an odd multiple of a quarter-wavelength at a first frequency responsive to connecting a radiator MEMS and an effective length of an odd multiple of a quarter-wavelength at a second frequency responsive to disconnecting the radiator MEMS; and, a planar counterpoise groundplane.

38. A wireless telephone communications device comprising:

a transceiver with an antenna port; and, a selectively connectable MEMS;

a first planar parasitic element, electrically coupled to the selectively connectable MEMS, and having reconfigurable sizes and locations;

a second planar parasitic element, electrically coupled to the selectively connectable MEMS, and having reconfigurable sizes and locations;

a planar active element proximate the first planar parasitic element and coupled to the antenna port.

39. The wireless communications device of claim 38 wherein the active element includes a selectively connectable MEMS.

40. The wireless communications device of claim 38 wherein the active element is a dipole.

41. The wireless communications device of claims 38 wherein the active element is a monopole.

42. The wireless communications device of claims 38 wherein the active element is a patch antenna.

43. A method of varying an antenna beam pattern of an antenna, the method comprising:

generating a first antenna beam pattern from an active element;

connecting a microelectromechanical switch (MEMS);

coupling a first parasitic element to a second parasitic element in response to connecting the MEMS; and generating a second antenna beam pattern in response to the coupling.

44. The method of claim 43 further comprising connecting a plurality of MEMS;

coupling a first plurality of parasitic elements to a second plurality of parasitic elements in response to connecting the plurality of MEMS.

45. The method of claim 43 further comprising:

electromagnetically communicating at a frequency responsive to the electrical length of the active element.

46. The method of claim 45 wherein electromagnetically communicating includes communicating at a frequency selected from the group including 824 to 894 megahertz (MHz), 1850 to 1990 MHz, 1565 to 1585 MHz, and 2400 to 2480 MHz.

47. The method of claim 43 further comprising generating the first antenna beam pattern in response to a first phase relationship between the active element and one of the parasitic elements.

48. The method of claim 47 further comprising generating the second antenna beam pattern in response to a second phase relationship between the active element and one of the parasitic elements.

* * * * *